US007645366B2

(12) United States Patent
Hanson et al.

(10) Patent No.: US 7,645,366 B2
(45) Date of Patent: Jan. 12, 2010

(54) MICROELECTRONIC WORKPIECE HOLDERS AND CONTACT ASSEMBLIES FOR USE THEREWITH

(75) Inventors: Kyle M. Hanson, Kalispell, MT (US); Jurek K. Koziol, Whitefish, MT (US); John M. Pedersen, Kalispell, MT (US); Michal A. Zmaj, Ridgecrest, CA (US)

(73) Assignee: Semitool, Inc., Kalispell, MT (US)

( * ) Notice: Subject to any disclaimer, the term of this patent is extended or adjusted under 35 U.S.C. 154(b) by 699 days.

(21) Appl. No.: 11/248,667

(22) Filed: Oct. 12, 2005

(65) Prior Publication Data

US 2006/0226000 A1 Oct. 12, 2006

Related U.S. Application Data

(63) Continuation-in-part of application No. 09/717,927, filed on Nov. 20, 2000, now Pat. No. 6,527,925, and a continuation-in-part of application No. 09/823,948, filed on Mar. 31, 2001, now Pat. No. 6,773,560.

(60) Provisional application No. 60/619,547, filed on Oct. 14, 2004.

(51) Int. Cl.
*C25B 9/02* (2006.01)

(52) U.S. Cl. ..... 204/297.08; 204/297.07

(58) Field of Classification Search ..... 204/297.07, 204/297.08

See application file for complete search history.

(56) References Cited

U.S. PATENT DOCUMENTS 4,137,867 A 2/1979 Aigo
4,246,088 A 1/1981 Murphy
4,259,166 A 3/1981 Whitehurst (Continued)

FOREIGN PATENT DOCUMENTS

WO WO-99/25904 5/1999

(Continued)

OTHER PUBLICATIONS

Semitool, Inc.; Design Review for Equinox Tool; Plater Quote 96-135e; dated Jul. 15, 1996; pp. 1-20.

(Continued)

*Primary Examiner*—Bruce F Bell
(74) *Attorney, Agent, or Firm*—Perkins Coie, LLP; Kenneth H. Ohriner; Craig E. Bohn

(57) ABSTRACT

The invention provides an improved contact ring and an improved workpiece support, each of which is useful alone or jointly with the other in a workpiece holder for electrochemically treating microelectronic workpieces. Several embodiments of the invention provide a composite contact ring having a dielectric base carrying a conductor which delivers electric power to a microelectronic workpiece. The dielectric base may be rigid and define a plurality of rigid fingers, each of which carries a separate electrical contact of the conductor. Such a contact ring is expected to have a long service life and enhance uniformity of electrochemical treatment. Several embodiments of the invention provide a workpiece support which induces a control the flexure of a microelectronic workpiece without damaging the workpiece. This controlled flexure can ensure more uniform contact between the workpiece and a contact assembly despite variations in the workpiece and/or the contact assembly.

22 Claims, 13 Drawing Sheets

U.S. PATENT DOCUMENTS

| | | | | |
|---|---|---|---|---|
| 4,304,641 | A | 12/1981 | Grandia | |
| 4,341,629 | A | 7/1982 | Uhlinger | |
| 4,422,915 | A | 12/1983 | Beale | |
| 4,466,864 | A | 8/1984 | Bacon | |
| 4,576,685 | A | 3/1986 | Goffredo | |
| 4,685,414 | A | 8/1987 | Di Rico | |
| 4,913,085 | A | 4/1990 | Vohringer | |
| 5,135,636 | A | 8/1992 | Yee | |
| 5,139,818 | A | 8/1992 | Mance | |
| 5,227,041 | A | 7/1993 | Brogden | |
| 5,271,953 | A | 12/1993 | Litteral | |
| 5,310,580 | A | 5/1994 | O'Sullivan | |
| 5,344,491 | A | 9/1994 | Katou | |
| 5,389,496 | A | 2/1995 | Calvert | |
| 5,441,629 | A | 8/1995 | Kosaki | |
| 5,443,707 | A | 8/1995 | Mori | |
| 5,447,615 | A | 9/1995 | Ishida | |
| 5,500,315 | A | 3/1996 | Calvert et al. | |
| 5,522,975 | A | 6/1996 | Andricacos | |
| 5,550,315 | A | 8/1996 | Stormont | |
| 5,597,460 | A | 1/1997 | Reynolds | |
| 5,597,836 | A | 1/1997 | Hackler | |
| 5,609,239 | A | 3/1997 | Schlecker | |
| 5,670,034 | A | 9/1997 | Lowery | |
| 5,744,019 | A | 4/1998 | Ang | |
| 5,747,098 | A | 5/1998 | Larson | |
| 5,776,327 | A | 7/1998 | Botts | |
| 5,788,829 | A | 8/1998 | Joshi | |
| 5,843,296 | A | 12/1998 | Greenspan | |
| 5,904,827 | A | 5/1999 | Reynolds | |
| 5,909,123 | A | 6/1999 | Budnaitis | |
| 5,932,077 | A | 8/1999 | Reynolds | |
| 5,985,126 | A | 11/1999 | Bleck | |
| 6,001,235 | A | 12/1999 | Arken | |
| 6,080,291 | A | 6/2000 | Woodruff | |
| 6,139,712 | A | 10/2000 | Patton | |
| 6,156,167 | A | 12/2000 | Patton | |
| 6,228,231 | B1 | 5/2001 | Uzoh | |
| 6,251,236 | B1 | 6/2001 | Stevens | |
| 6,267,853 | B1 | 7/2001 | Dordi et al. | |
| 6,303,010 | B1 | 10/2001 | Woodruff | |
| 6,309,520 | B1 | 10/2001 | Woodruff | |
| 6,309,524 | B1 | 10/2001 | Woodruff | |
| 6,326,587 | B1 | 12/2001 | Cardineau | |
| 6,540,899 | B2 | 10/2002 | Keigler | |
| 6,527,925 | B1 * | 3/2003 | Batz et al. | 204/297.01 |
| 6,579,430 | B2 | 5/2003 | Davis et al. | |
| 6,645,356 | B1 | 11/2003 | Woodruff | |
| 6,699,373 | B2 * | 3/2004 | Woodruff et al. | 204/198 |
| 6,869,510 | B2 * | 3/2005 | Woodruff et al. | 204/297.01 |
| 6,911,127 | B2 * | 6/2005 | Batz et al. | 204/280 |
| 6,939,448 | B2 * | 9/2005 | Batz et al. | 204/224 R |
| 6,962,649 | B2 * | 11/2005 | Wilson et al. | 204/224 R |
| 7,048,841 | B2 * | 5/2006 | Batz et al. | 205/221 |
| 7,294,243 | B2 * | 11/2007 | Zimmerman et al. | 204/224 R |
| 2002/0053510 | A1 | 5/2002 | Woodruff et al. | |
| 2003/0010640 | A1 | 1/2003 | Kholodenko | |
| 2003/0173209 | A1 | 9/2003 | Batz et al. | |

FOREIGN PATENT DOCUMENTS

| | | |
|---|---|---|
| WO | WO-99/25905 | 5/1999 |
| WO | WO-00/03072 | 1/2000 |
| WO | WO-00/32835 | 6/2000 |

OTHER PUBLICATIONS

Semitool, Inc.; Quotation for Sale of Plating Tool; Single Substrate Processor Division; Quote 96-135e; dated Jul. 24, 1996; pp. 1-5.

* cited by examiner

FIG 8A
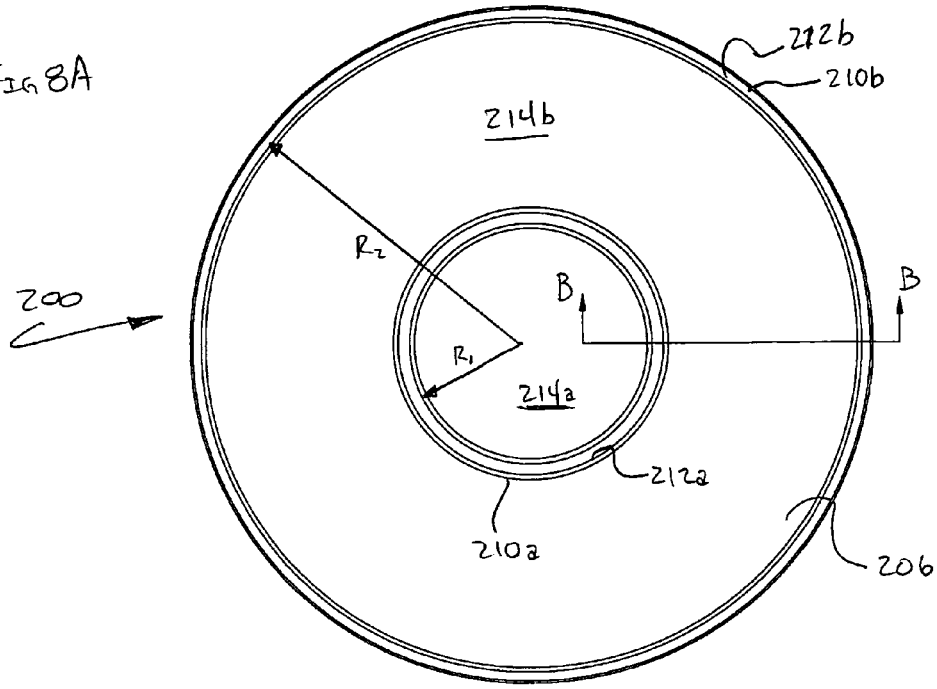
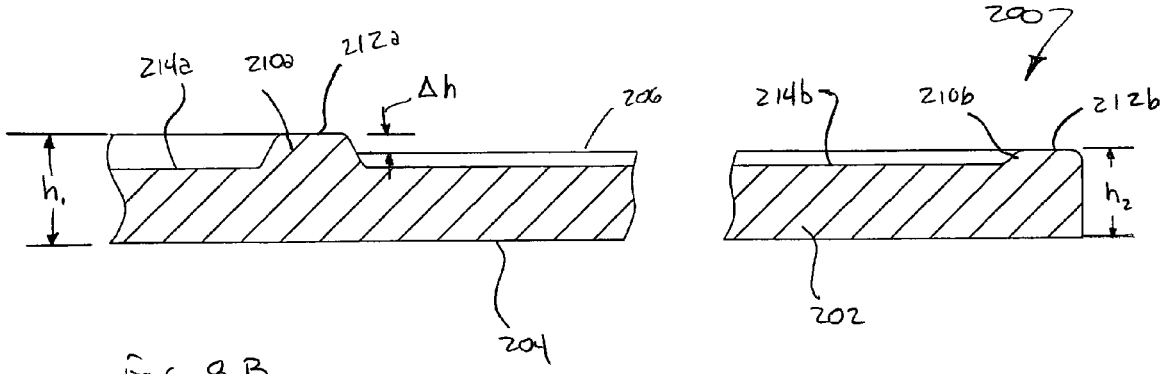
FIG. 8 B

MICROELECTRONIC WORKPIECE HOLDERS AND CONTACT ASSEMBLIES FOR USE THEREWITH

CROSS-REFERENCE TO RELATED APPLICATIONS

This application claims benefit of U.S. Provisional Application No. 60/619,547, filed Oct. 14, 2004. The present application is a continuation-in-part and claims priority from U.S. patent application Ser. No. 09/717,927, filed Nov. 20, 2000; and U.S. patent application Ser. No. 09/823,948, filed Mar. 31, 2001. Both of the foregoing applications—as well as U.S. patent application Ser. No. 09/113,723 filed Jul. 10, 1998; and PCT Patent Application No. PCT/US99/15847 filed Jul. 12, 1999—are herein incorporated by reference in their entirety.

TECHNICAL FIELD

The present invention generally relates to electrochemically treating microelectronic workpieces and specifically relates to improved workpiece holders and contact assemblies for use in electrochemically treating microelectronic workpieces.

BACKGROUND

Processors, memory devices, field-emission-displays, read/write heads and other microelectronic devices generally have integrated circuits with microelectronic components. A large number of individual microelectronic devices are generally formed on a semiconductor wafer, a glass substrate, or another type microelectronic workpiece. In a typical fabrication process, one or more layers of metal are formed on the workpieces at different stages of fabricating the microelectronic devices to provide material for constructing interconnects between various components.

The metal layers can be applied to the workpieces using several techniques, such as chemical vapor deposition (CVD), physical vapor deposition (PVD), plasma-enhanced deposition processes, electroplating, and electroless plating. The particular technique for applying a metal to a workpiece is a function of the particular type of metal, the structure that is being formed on the workpiece, and several other processing parameters. For example, CVD and PVD techniques are often used to deposit aluminum, nickel, tungsten, solder, platinum and other metals. Electroplating and electroless plating techniques can be used deposit copper, solder, permalloy, gold, silver, platinum and other metals. Electroplating and electroless plating can be used to form blanket layers and patterned layers. In recent years, processes for plating copper have become increasingly important in fabricating microelectronic devices because copper interconnects provide several advantages compared to aluminum and tungsten for high-performance microelectronic devices.

Electroplating is typically performed by forming a thin seed-layer of metal on a front surface of a microelectronic workpiece, and then using the seed-layer as a cathode to plate a metal layer onto the workpiece. The seed-layer can be formed using PVD, CVD or electroless plating processes. The seed-layer is generally formed on a topographical surface having vias, trenches, and/or other features, and the seed-layer is approximately 500-1000 angstroms thick. The metal layer is then plated onto the seed-layer using an electroplating technique to a thickness of approximately 6,000 to 15,000 angstroms. As the size of interconnects and other microelectronic components decrease, it is becoming increasingly important that the plated metal layer (a) has a uniform thickness across the workpiece, (b) completely fills the vias/trenches, and (c) has an adequate grain size.

Electroplating machines for use in manufacturing microelectronic devices often have a number of single-wafer electroplating chambers. A typical chamber includes a container for holding an electroplating solution, an anode in the container to contact the electroplating solution, and a support mechanism having a contact assembly with electrical contacts that engage the seed-layer. The electrical contacts are coupled to a power supply to apply a voltage to the seed-layer. In operation, the front surface of the workpiece is immersed in the electroplating solution so that the anode and the seed-layer establish an electrical field that causes metal in a diffusion layer at the front surface of the workpiece to plate onto the seed-layer.

The structure of the contact assembly can significantly influence the uniformity of the plated metal layer because the plating rate across the surface of the microelectronic workpiece is influenced by the distribution of the current (the "current density") across the seed-layer. One factor that affects the current density is the distribution of the electrical contacts around the perimeter of the workpiece. In general, a large number of discrete electrical contacts should contact the seed-layer proximate to the perimeter of the workpiece to provide a uniform distribution of current around the perimeter of the workpiece. Another factor that affects the current density is the formation of oxides on the seed-layer. Oxides are generally resistive, and thus oxides reduce the efficacy of the electrical connection between the contacts and the seed-layer. Still other factors that can influence the current density are (a) galvanic etching between the contacts and the seed-layer, (b) plating on the contacts during a plating cycle, (c) gas bubbles on the seed-layer, and (d) other aspects of electroplating that affect the quality of the connection between the contacts and the seed-layer or the fluid dynamics at the surface of the workpiece. The design of the contact assembly should address these factors to consistently provide a uniform current density across the workpiece.

One type of contact assembly is a "dry-contact" assembly having a plurality of electrical contacts that are sealed from the electroplating solution. For example, U.S. Pat. No. 5,227,041 issued to Brogden et al. discloses a dry contact electroplating structure having a base member for immersion into an electroplating solution, a seal ring positioned adjacent to an aperture in the base member, a plurality of contacts arranged in a circle around the seal ring, and a lid that attaches to the base member. In operation, a workpiece is placed in the base member so that the front face of the workpiece engages the contacts and the seal ring. When the front face of the workpiece is immersed in the electroplating solution, the seal ring prevents the electroplating solution from engaging the contacts inside the base member.

Another type of contact assembly is a "wet-contact" assembly wherein the electrical contacts are permitted to contact the electroplating solution. One problem associated with such contacts is "thieving" of metal intended for the front face of the workpiece. This "thieved" metal is commonly deposited on the surface of the contact rather than the surface of the workpiece. This fouls the contact and changes its electrical conductivity over time. Particularly where thieving occurs more at one location than at another, this can adversely impact uniformity of the current density across the workpiece, leading to non-uniform plated metal layers.

Dry-contact assemblies can minimize thieving by keeping the electrical contacts outside of the plating solution. However, the seals required to isolate the electrical contacts occupy valuable real estate on the front face of the microelectronic workpiece. In addition, the presence and thickness of the seal can induce turbulence in the flow of the electroplating solution at the workpiece surface and trap bubbles at the interior perimeter of the seal during operation. Increased in turbulence and bubbles can both adversely impact plating uniformity.

SUMMARY

The present invention is generally directed toward microelectronic workpiece holders, contact assemblies, and support plates for microelectronic workpiece holders. In one embodiment of the invention, the workpiece holder can include both a novel contact assembly in accordance with one aspect of the invention and a novel support plate in accordance with another aspect of the invention. Several embodiments of such workpiece holders facilitate uniform electrical contact with a microelectronic workpiece with reduced thieving, enhancing product uniformity. Several embodiments of the invention provide workpiece holders well-suited for wet-contact applications with enhanced service life and reduced thieving.

A workpiece holder in accordance with one embodiment of the invention is useful for supporting a microelectronic workpiece for electrochemical treatment, such as electroplating or deplating. This workpiece holder includes a contact ring and a support. The contact ring has a central opening and is adapted to deliver electrical power to the workpiece front surface. The support is adapted to urge the workpiece front surface against the contact ring while contacting the back surface of the workpiece. In particular, the support contacts an inner location on the workpiece back surface at a first height with respect to the contact ring and contacts an outer location on the workpiece back surface at a second height with respect to the contact ring. The first height is greater than the second height. When the support forces the workpiece toward the contact ring, this height differential can induce a controlled flexure of the workpiece, facilitating good electrical contact between the contact ring and the workpiece front surface. If so desired, both the contact ring and the support plate may be rigid, which can materially enhance the useful life of the workpiece holder.

Other embodiments of the invention provide composite contact rings and contact assemblies employing composite contact rings. These novel contact rings can be used in flexure-inducing workpiece holders in accordance with several embodiments of the invention. However, these contact rings can be used in a variety of other applications, including more conventional workpiece holder constructions.

In one embodiment of the invention useful in wet-contact assemblies, a composite contact ring includes a dielectric base, a conductor, and a dielectric coating. The dielectric base has a contact face and an interior opening through which an electrolyte might pass to contact a surface of a microelectronic workpiece. A conductor is carried by the contact face of the base. The conductor includes an outer busbar and a plurality of spaced-apart contacts extending inwardly from and electrically coupled to the busbar. The dielectric coating covers at least a portion of the busbar, with at least a portion of each of the contacts remaining exposed for electrically contacting the workpiece. In this embodiment, the dielectric base and dielectric coating can enhance operation of the contact ring in wet-contact applications.

A composite electrochemistry contact ring in accordance with another embodiment to the invention employs a rigid dielectric base having a peripheral member and a plurality of fingers extending inwardly from the peripheral member. A plurality of electrical contacts are provided, with each electrical contact being carried on a finger of the base. Each contact also has an exposed contact pad adapted to electrically contact a conductive surface of a microelectronic workpiece. A busbar is carried by the peripheral member of the base. The busbar is adapted to electrically couple the electrical contacts to an electroplating power source. If so desired, the electrical contacts and the busbar may be applied as a conductive metal trace on a ceramic base, providing a durable, dimensionally stable contact ring.

BRIEF DESCRIPTION OF THE DRAWINGS

FIG. 8A is a top plan view of the workpiece support shown in the workpiece holder of FIG. 3.

FIG. 8B is a broken-away partial cross-sectional view taken along line B-B in FIG. 8A.

DETAILED DESCRIPTION

Figure 1:
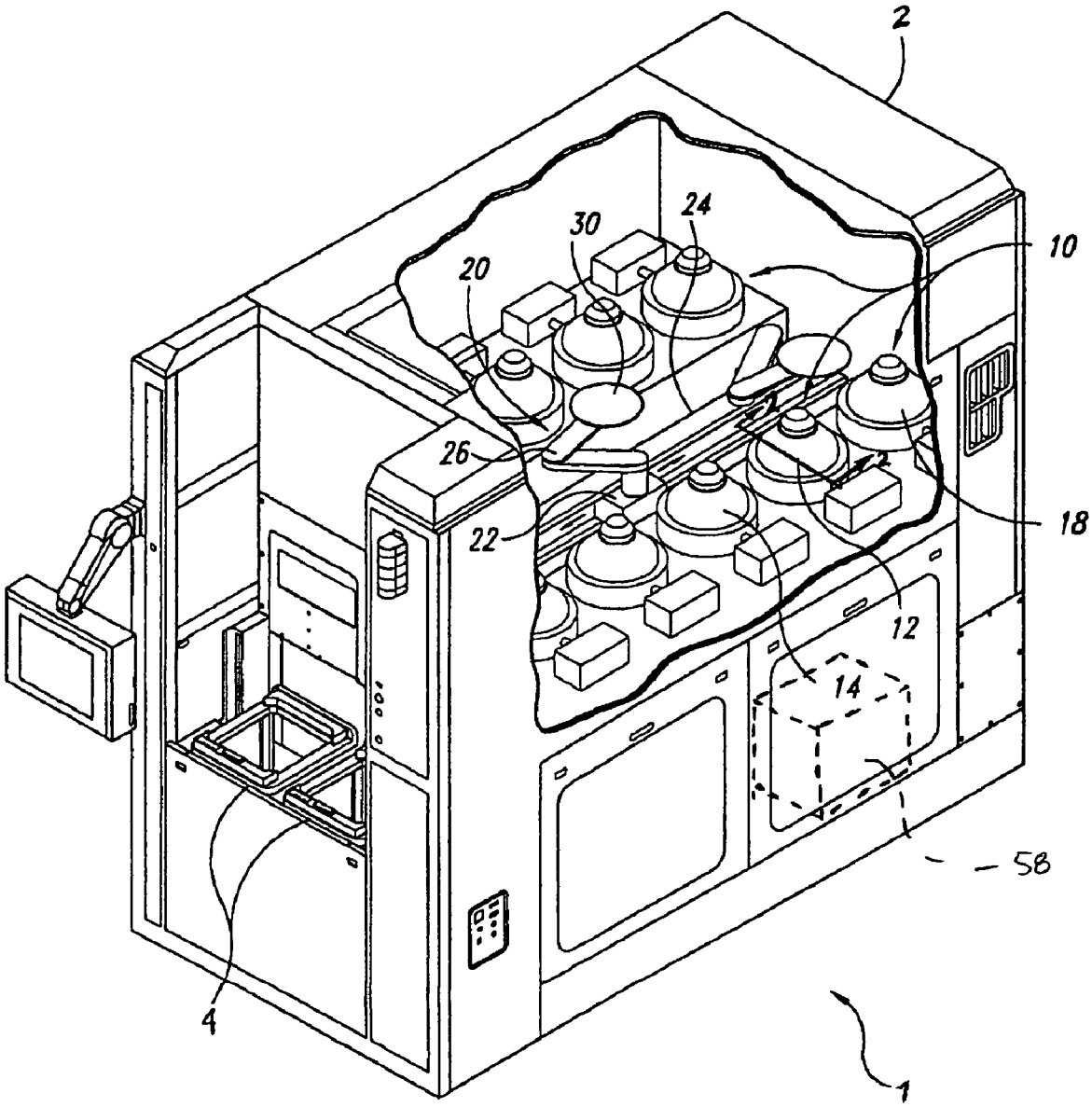
FIG. 1 is an isometric view with a cut-away portion of an electroplating machine having a contact assembly in accordance with one embodiment of the invention.

Various embodiments of the present invention provide contact assemblies, and methods of making contact assemblies and electroplating machines with contact assemblies for electroplating materials onto microelectronic workpieces. The following description provides specific details of certain embodiments of the invention illustrated in the drawings to provide a thorough understanding of those embodiments. It should be recognized, however, that the present invention can be reflected in additional embodiments and the invention may be practiced without some of the details in the following description.

The operation and features of the contact assemblies are best understood in light of the environment and equipment in which they can be used to electroplate workpieces. As such, several embodiments of electroplating tools and reaction chambers that can be used with the contact assemblies will be described with reference to FIGS. 1 and 2. The details and features of several embodiments of wafer holders, contact assemblies, and support plates will then be described with reference to FIGS. 3-13.

A. Selected Embodiments of Electrochemical Processing Machines and Reactor Chambers for Use With Workpiece Holders FIG. 1 is a front isometric view of an electrochemical processing machine 1 in which workpiece holders in accordance with embodiments of the invention can be used. The machine 1 can include a cabinet 2, a load/unload mechanism 4 at one end of the cabinet 2, and a plurality of chambers 10 in the cabinet 2. The chambers 10 can include electrochemical processing chambers 12, electroless plating chambers 14, rapid thermal annealing chambers 18, and/or cleaning chambers. The electrochemical processing machine 1 can also include a transfer mechanism 20 having a rail or track 22 and a plurality of robots 24 that move along the track 22. The robots 24 include arms 26 that can carry a microelectronic workpiece 30 between the chambers 10. In operation, the load/unload mechanism 4 positions a cassette or pod holding a plurality of workpieces either in the cabinet 2 or at an opening of the cabinet, and the transfer mechanism 20 handles the individual workpieces 30 inside the cabinet 2. The transfer mechanism 20, for example, can initially place the workpiece 30 in an electroless plating chamber 14 to repair or enhance the seed-layer on the workpiece. The transfer mechanism 20 can then remove the workpiece 30 from the electroless plating chamber 14 and place it in the electrochemical treatment chamber 12 for forming a blanket layer or a patterned layer on the front face of the workpiece 30 by electroplating. After the electroplating cycle, the transfer mechanism 20 can remove the workpiece 30 from the electrochemical treatment chamber 12 and transfer it to another processing station in the machine 1 (e.g., a standard rinser-dryer, a rinse/etch capsule, etc.) or place it in the cassette. In an alternative embodiment, the transfer mechanism can be a radial system such as in the EQUINOX® machines manufactured by Semitool, Inc. of Kalispell, Mont.

Figure 2:
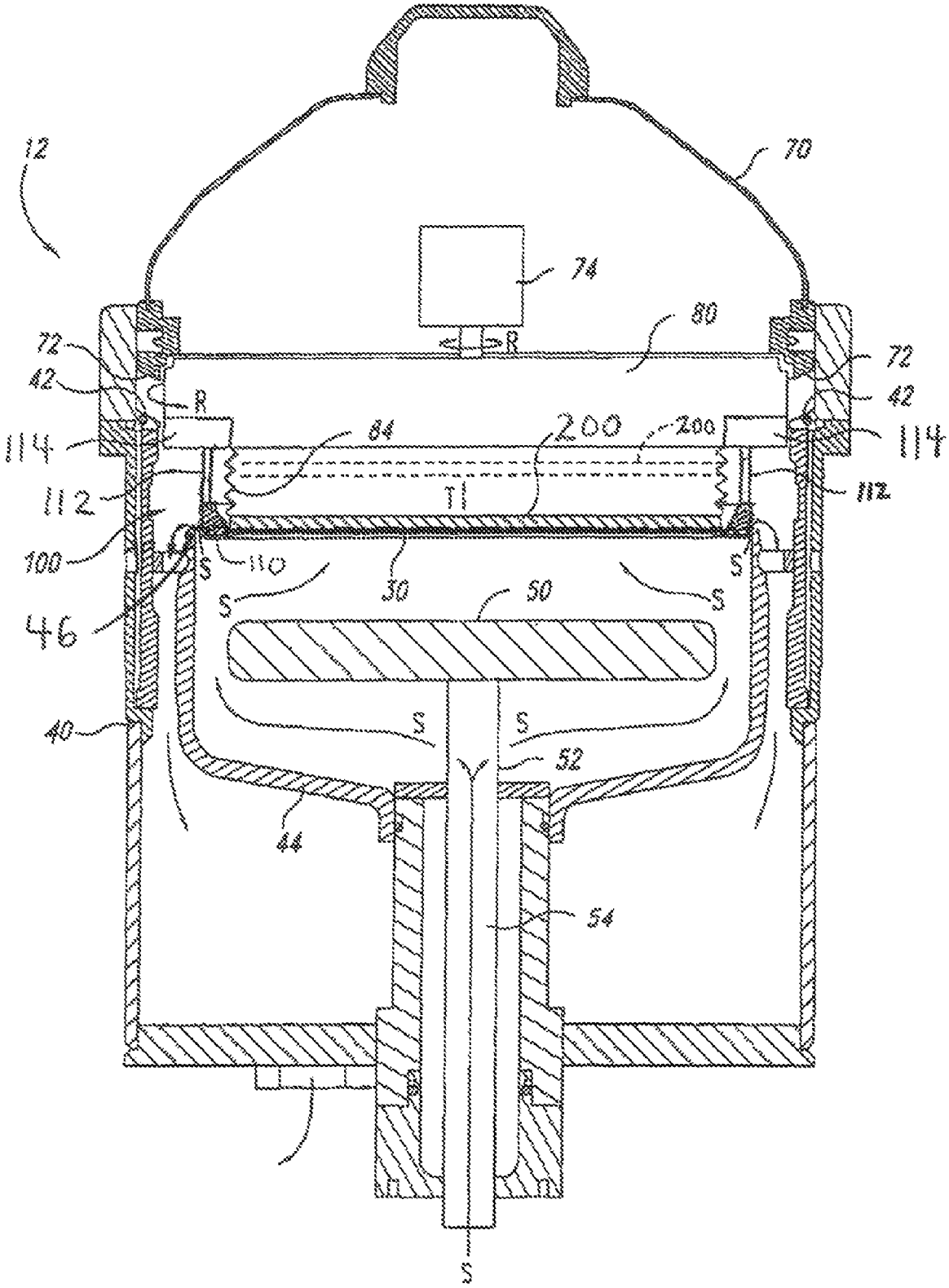
FIG. 2 is a cross-sectional view, taken along line 2-2 of FIG. 1, of an electroplating chamber having a contact assembly for use in an electroplating machine in accordance with an embodiment of the invention.

FIG. 2 is a partial cross-sectional view of an electrochemical treatment chamber 12 having a workpiece holder 100 in accordance with one embodiment of the invention for supporting and providing an electrical connection to the workpiece 30. For the purposes of brevity, several components of the electrochemical treatment chamber 12 are shown schematically or by line drawings. Many of the particular features of the components shown schematically are described more detail in the patent applications incorporated by reference above. The chamber 12 can include a bowl 40 configured to contain an electrochemical solution, e.g., an electroplating solution, an electrode 50 in the bowl 40, and a head assembly 70 that carries the wafer holder 100. The head assembly 70 is movable with respect to the bowl 40 to position the workpiece 30 in the electrochemical solution (not shown). When the head assembly 70 is fully inserted into the bowl 40, a beveled surface 72 of the head assembly 70 is superimposed over a corresponding beveled surface 42 of the bowl 40, and the workpiece holder 100 holds the workpiece 30 in a desired position relative to the plating solution.

The bowl 40 can include a cup 44 having an overflow weir 46. The electrode 50 is positioned in the cup 44, and the electrode 50 can be carried by an electrode support assembly 52. In one embodiment, the electrode support assembly 52 has a channel 54 through which the electrochemical solution flows and is discharged into the cup 44, but in other embodiments the electrochemical solution can flow into the cup 44 separately from the electrode support assembly 52. The electrode support assembly 52 can be electrically conductive, or it can include a conductor to electrically couple the electrode 50 to an electrical power supply (shown schematically as 58 in FIG. 1). In operation, a flow of electrochemical solution (identified schematically by arrows "S") flows past the electrode 50, over the weir 46, and into a lower portion of the bowl 40. As the flow of electrochemical solution passes over the weir 46, it forms a meniscus at the top of the cup 44. The electrochemical solution flow S can then pass out of the bowl 40 where it is filtered and reconditioned so that the electrochemical solution can be re-circulated through the cup 44. Suitable embodiments of bowls 40, cups 44, electrodes 50 and electrode support assemblies 52 are described in PCT Application Nos. PCT/US99/15430, PCT/US00/10120, and PCT/US00/10210, all of which are herein incorporated in their entirety by reference.

The head assembly 70 can further include a motor 74 and a rotor 80 that carries the workpiece holder 100. The motor 74 is coupled to the rotor 80 to rotate the workpiece holder 100 and the workpiece 30 during a plating cycle (Arrow R). The workpiece holder 100 can include a movable support plate 200 and a seal 84. The support plate 200 can move transverse to the workpiece 30 (Arrow T) between a first position in which the support plate 200 engages the back surface of the workpiece 30 (shown in solid lines in FIG. 2) and a second position in which it is spaced apart from the back surface of the workpiece 30 (shown in broken lines in FIG. 2). In this embodiment, the workpiece holder 100 is coupled to the rotor 80 by a plurality of shafts 112 that are received in quick-release mechanisms 114. The shafts 112 can be rigid, conductive members that electrically couple a contact assembly 110 of the workpiece holder 100 to an electrical power supply (58 in FIG. 1) to establish an electrical potential with respect to the electrode 50. For example, the seed-layer on the workpiece 30 may function as a cathode and the electrode 50 may function as an anode for plating or the seed layer may function as an anode and the electrode 50 may function as a cathode for electropolishing.

In operation, the head assembly 70 can be initially raised above the bowl 40 and rotated about a relatively horizontal axis so the workpiece holder 100 faces upward away from the bowl 40. The support plate 200 is moved to the second position in which it is spaced apart from the contact assembly 110 to load the workpiece 30 into the head assembly 70. The robot 24 (FIG. 1) inserts the workpiece 30 face-up into the workpiece holder 100, and then the support plate 200 moves to the first position in which it forces the workpiece 30 against the contact assembly 110. The head assembly 70 then rotates about the horizontal axis to position the workpiece holder 100 face downward and lowers at least a portion of the loaded workpiece 30 and a portion of the contact assembly 110 into the electrochemical solution proximate to the overflow weir 46. The motor 74 rotates the rotor 80 to move the workpiece 30 in the electrochemical solution during the treatment cycle. After the electrochemical treatment is complete, the head assembly 70 removes the workpiece 30 from the electrochemical solution so that it can be rinsed and/or transferred to another processing chamber or machine. In an alternative embodiment, the head assembly does not rotate about the horizontal axis to position the contact assembly 100 face-up during a load/unload sequence such that the workpiece is loaded into the contact assembly face-down toward the bowl 40.

The foregoing description of the electrochemical processing machine 100 and the electrochemical processing chamber 12 provides examples of the types of devices in which workpiece holders, contact assemblies, and workpiece supports in accordance with embodiments of the invention can be used to plate metal layers onto microelectronic workpieces. It will be appreciated that the workpiece holder 100, and other embodiments of workpiece holders, described in more detail below, can be used with other electrochemical processing machines and reaction chambers.

B. Selected Embodiments of Workpiece Holders for Electrochemical Processing of Microelectronic Workpieces FIGS. 3-13 illustrate several embodiments of workpiece holders, contact assemblies, and workpiece supports that can be used in the electrochemical processing chamber 12 of the electrochemical processing machine 1. The structures and operation of the embodiments shown in FIGS. 3-13 are generally described with reference to electroplating applications. It will be appreciated, however, that they can also be configured for use in connection with other electrochemical treatments or for use as non-electrical workpiece support assemblies in electroless plating applications, for example.

Figure 3:
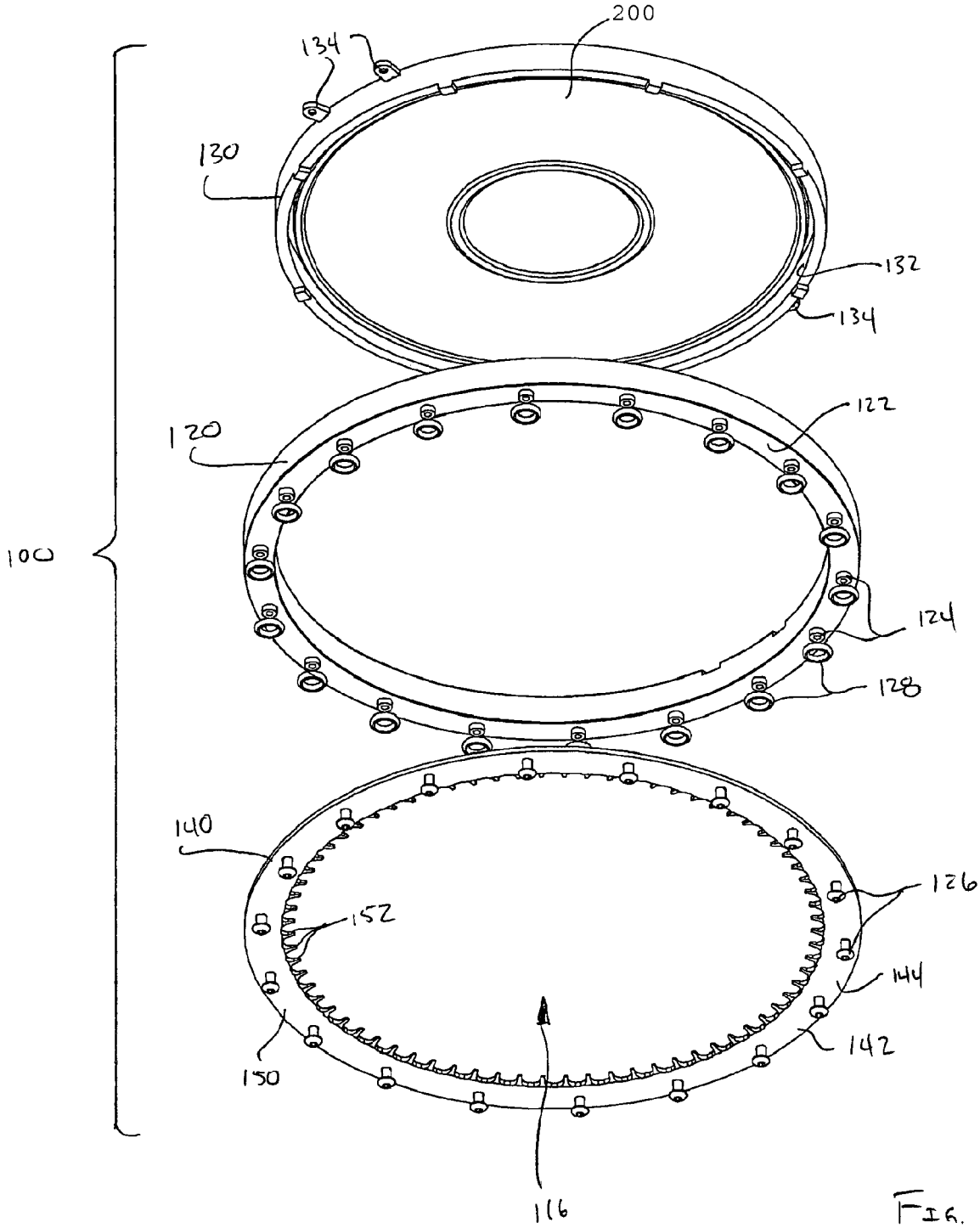
FIG. 3 is an exploded isometric view of selected components of a workpiece holder in accordance with one embodiment of the invention.

FIG. 3 is a schematic, exploded view of selected components of a workpiece holder 100 in accordance with one embodiment of the invention. The workpiece holder 100 generally includes a coupling member 120, a guide ring 130, a contact ring 140 and a support plate 200. The coupling member 120, guide ring 130, and contact ring 140 may remain stationary with respect to one another during operation of the workpiece holder 100 and together define a contact assembly 110. The workpiece support 200 is movable with respect to the contact assembly 110, as noted above and discussed in more detail in connection with FIGS. 11-13.

The guide ring 130 may include a plurality of tabs 134 extending radially outwardly to rest on a rear surface 123 of the coupling member 120. These tabs may have through-holes to facilitate attachment of the guide ring 130 to the coupling member 120. The guide ring 130 also includes an inclined guide surface 132 which slopes radially inwardly toward the contact ring 140 (see, e.g., FIG. 5). The guide surface 132 can help guide a workpiece so it is properly positioned with respect to the contact ring 140. The contact ring 130 may be formed of a dielectric material, such as a dielectric plastic compatible with the workpiece and the electrochemical solution.

The contact ring 140 is electrically coupled to and may be carried by the coupling member 120. Coupling member 120 should be formed of a conductive material, such as a solid ring of metal, and may be electrically coupled to the electrical power supply 58 (FIG. 1) via the conductive shafts 112 (FIG. 2). The contact ring 140 may be attached to the coupling member 120 in any suitable fashion. In the illustrated embodiment, the coupling member 120 includes a plurality of bosses 124 arranged equilangularly about the forward surface 122 of the coupling member 120. A plurality of bolts 126 may be passed through the contact ring 140 and threaded into the bosses 124 to attach the contact ring 140 to the coupling member 120. If so desired, an O-ring 128 may be positioned about each of the bosses 124 and extend between the contact ring 140 and the coupling member 120 (see, e.g., FIGS. 5 and 6).

1. Selected Embodiments of Contact Rings

Figure 4A:
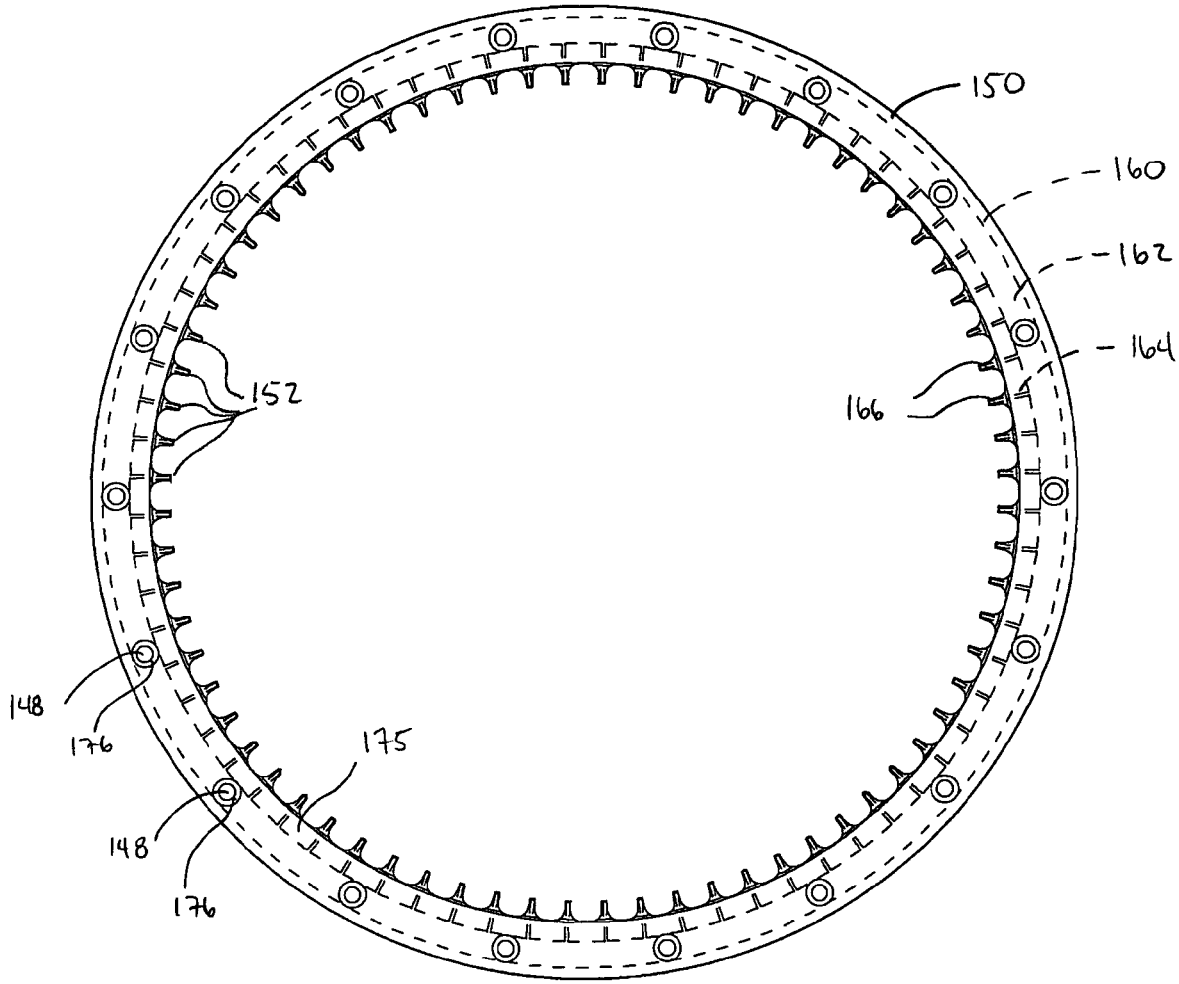
FIG. 4A is a front plan view of the contact ring of the workpiece holder shown in FIG. 3.
Figure 4B:
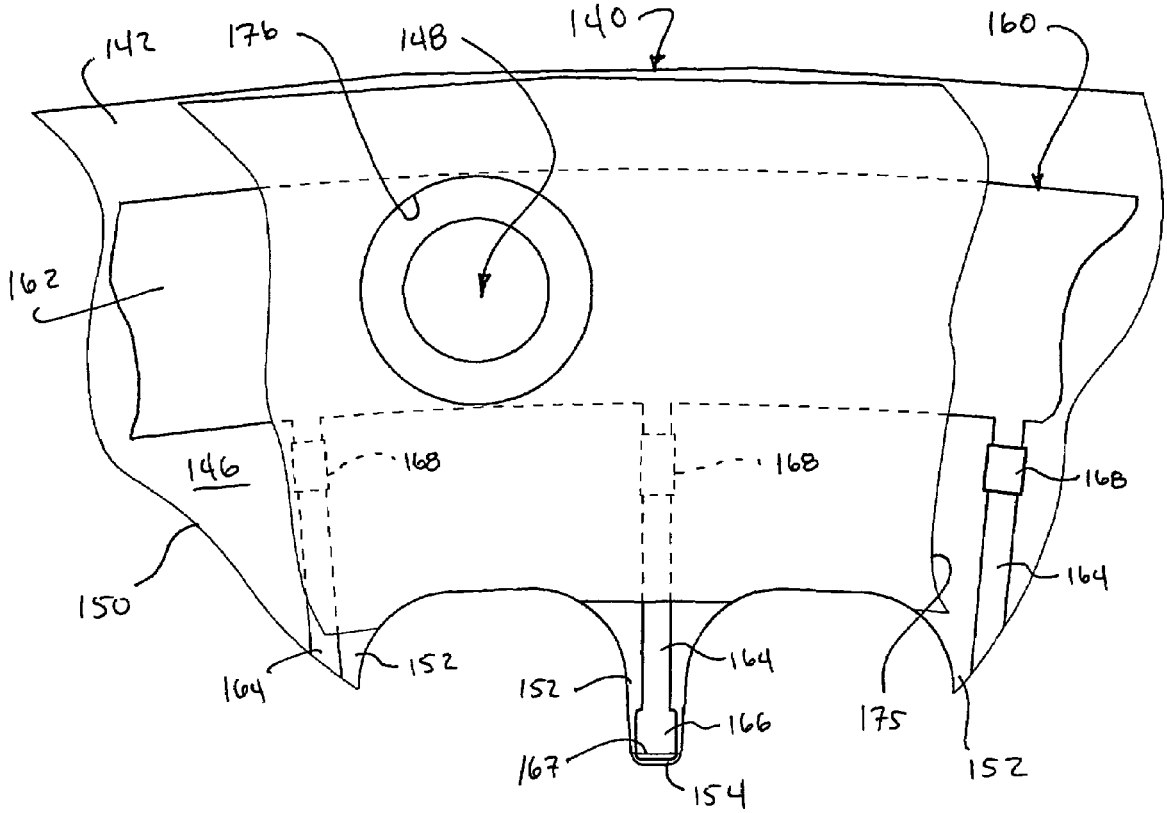
FIG. 4B is a front isolation view schematically illustrating a portion of the contact ring of FIG. 4A.
Figure 5:
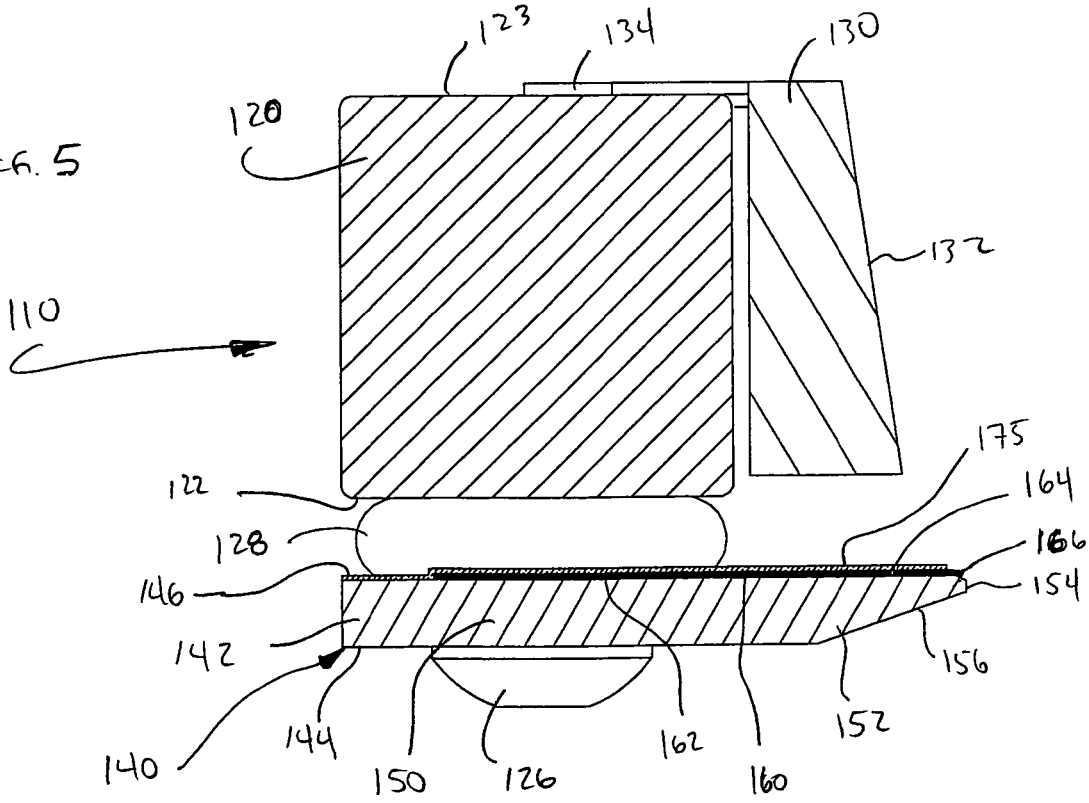
FIG. 5 is a partial cross-sectional view of a contact assembly in accordance with one embodiment of the invention.

The contact ring 140 shown in FIGS. 3-5 includes a base 142 having a front face 144, which may be oriented toward the electrochemical solution in the bowl 40 (FIG. 2), and a contact face 146 oriented toward the forward surface 122 of the coupling member 120. The base 142 generally includes an annular peripheral member 150 and a plurality of fingers 152. The peripheral member 150 may include holes 148 through which the bolts 126 may be passed to couple the contact ring 140 to the coupling member 120. The number, spacing and orientation of the fingers can be varied as desired. In the illustrated embodiment, each of the fingers 152 extends generally radially inwardly from the annular peripheral member 150. The fingers 152 may be spaced equilangularly about the central opening 116 of the contact ring 140 to enhance uniformity of the current density. In the embodiment of FIG. 4A, the base 142 includes 72 fingers 152, each spaced 5 degrees from each next adjacent finger but more or fewer fingers could be used instead.

As best seen in FIG. 5, in one embodiment of the invention each finger may taper somewhat between the peripheral member 150 and the nose 154. This provides the nose 154 of each finger with a reduced profile. This reduced profile can improve the fluid dynamics of an electrochemical solution flowing outwardly over the overflow weir 46 as the rotor 80 rotates the workpiece holder 100. The entire length of each finger 152 may be tapered in a uniform fashion. In another embodiment, shown in FIG. 5, only a distal length 156 of each finger 152 is tapered.

The contact ring 140 also includes a conductor 160 carried on, and which may be bonded directly to, the contact face 146 of the base 142. The conductor 160 generally includes a busbar 162 and a plurality of contacts 166. A separate contact 166 may be carried by each finger 152, with the contact 166 being positioned adjacent a nose 154 of the finger 152. The contact 166 is electrically coupled to the busbar 162, such as by a lead 164 extending radially inwardly from the busbar 162. When the busbar 162 is operatively coupled to the electrical power source (58 in FIG. 1) and the electrical power source 58 is energized, electrical power carried by the busbar 162, can be delivered to each of the contacts 166 by a separate lead 164.

Each of the leads 164 may have the same width as the associated contact 166, i.e., the contact 166 may simply comprise an undifferentiated length of the lead 164. In the embodiment shown in FIG. 4B, however, the lead has a width which is less than the width of the contact 166. If the lead 164 and the contact 166 each have the same thickness, this reduced width will give the lead 164 a reduced cross-sectional area, reducing total conductivity of the lead 164. By appropriately controlling the cross-sectional area of the lead 164, the lead 164 can function as a resistor disposed between the busbar 162 and the contact pad 166. This "resistor" can help reduce variations in the current delivered by the busbar 162 to the various contacts 166 of the contact ring 140, enhancing current density uniformly on the seed layer of the microelectronic workpiece.

As explained below, the conductor 160 is desirably a relatively thin layer of a conductive material bonded directly to the contact face 146 of the base 142. With the relatively thin leads 164, smaller variations in the thickness of the lead 164 during manufacture can lead to varying currents delivered to the contacts 166. To minimize these production variations, a resistor 168 may be included in each of the leads 164. The resistor 168 may comprise a length of the lead 164 having an increased resistance. The increased resistance can be provided in a variety of manners. In one embodiment, the resistor 168 comprises a length of the lead 164 formed of a material having a resistivity greater than the resistivity of the material of which the rest of the lead 164 is formed. For example, the busbar 162, the contact pads 166 and the majority of each lead 164 may comprise a highly conductive noble metal, such as gold or platinum. A predetermined length of each lead 164 can be formed of a different material having a higher resistivity. The material of the resistor 168 may be a metal alloy, a mixture of a metal and a silicide or a mixture of metal and a metal oxide.

The contact face 146 of each finger 152 may be generally flat, leaving the lead 164 and contact 166 carried by the finger with a generally linear profile. As shown in FIG. 5, however, the nose 154 may have a non-linear profile. In particular, it may be angled with respect to a plane perpendicular to an axis of the interior opening 116 of the contact ring 140. This will provide the contact 166 with a non-linear profile, as well, defining a preferred line of contact 167 of the contact 166 with a curved microelectronic workpiece 30. If the microelectronic workpiece 30 is substantially flat, the length of the contact 166 extending radially outwardly beyond the line of contact 167 will contact the face of the microelectronic workpiece.

The contact ring 140 may also include a dielectric coating 175. If the contact ring 140 is to be used in a dry contact operation wherein it is effectively sealed from the electrochemical solution in the bowl 40 during use, the dielectric coating 175 likely is unnecessary. If the contact assembly 100 is used in a wet-contact operation, the dielectric coating 175 can reduce thieving by the contact ring 140 and avoid any undue fouling of the contacts 166 due to reaction with the electrochemical solution.

The dielectric coating 175 may cover a majority of the busbar 162 and may also cover a length of each of the leads 164. This leaves the contacts 166 exposed to promote electrical contact between the contacts 166 and the microelectronic workpiece 30 in use. In one embodiment, the dielectric coating 175 covers the entire lead 164, leaving only the contact 166 exposed. This is schematically illustrated in FIG. 5. In an alternative embodiment of the invention, the dielectric coating 175 may be spaced radially outwardly from the contact 166, leaving a length of each of the leads 164 exposed, as suggested in FIG. 4B.

The dielectric coating 175 of the contact ring 140 may be provided with a plurality of openings 176, with each opening 176 being positioned concentrically about a hole 148 through the peripheral member 50 of the base for receiving a bolt 126. This permits the bosses 124 of the coupling member 120 to which the bolts 126 are connected to electrically contact the busbar 162 of the conductor 160. As a consequence, electrical power delivered to the coupling member 120 can be delivered to the contacts 166 of the contact ring 140 via the busbar 162 and leads 164.

The materials used in forming the contact ring 140 can be selected to achieve a variety of different design objectives. As noted above, however, the base 142 of the contact ring 140 is desirably formed of a dielectric material. In one embodiment, the dielectric material of the base 142 comprises a resilient material which may deform when a microelectronic workpiece 30 is forced against the fingers 152. This allows the fingers 152 to flex to accommodate any irregularities in the microelectronic workpiece 30 without unduly stressing the workpiece 30.

In an alternative embodiment of the invention, the base 142 of the contact ring 140 is formed of a rigid dielectric material, such as a dielectric ceramic. To facilitate manufacture, outlined below, and to reduce dimensional variations with any changes in temperature, the ceramic material may also be a refractory. Suitable ceramic materials include alumina and silicon carbide. Forming the base 142 of a rigid material minimizes the fatigue and wear associated with contacts which must repeatedly flex in use. This can significantly extend the useful life of the contact ring. Whereas metal contacts in use today sometimes must be replaced after electroplating 3,000-5,000 semiconductor wafers, it is anticipated that a contact ring 140 of the invention employing a rigid dielectric base 142 will have a service life in excess of 10,000 semiconductor wafers. The conductor 160 may be formed of any suitably conductive material which bonds well to the dielectric base 142. If the dielectric base 142 comprises a ceramic, the conductor 160 may comprise a metal which is bonded directly to the contact face 146 of the base 142. Metal can be bonded to a ceramic material fairly readily, yielding a structurally stable conductor with a relatively long service life. The conductor may, for example, comprise copper or gold.

The dielectric coating 175 may be formed of any suitable dielectric. In one embodiment, the dielectric coating 175 comprises a coating of a dielectric plastic which bonds well to both the dielectric base 142 and the conductor 160. In an alternative embodiment, the dielectric coating 175 instead comprises an inorganic dielectric material, such as a ceramic or glass, such as water glass. This can provide a more durable, wear-resistant dielectric coating 175. The bond of an inorganic dielectric coating 175 to a ceramic base 142 is also anticipated to be relatively strong and durable.

The contact ring 140 can be formed in any suitable fashion and the method of manufacture may vary somewhat depending on the nature of the materials selected for the base 142, conductor 160, and dielectric coating 175. If the base 142 is formed of a ceramic material, a rough blank of the base 142 may be formed using conventional ceramic forming processes, e.g., by slip casting or sol gel techniques. This rough blank may be bisque fired (if necessary to improve its raw structural strength in the green state) then initially machined to approximate the final desired shape. The blank may then be sintered at an elevated temperature then subjected to a final machining process. If the ceramic is a refractory ceramic, the machining may be performed using laser machining equipment to yield a precise shape, even with relatively complex finger profiles, without fear of overheating the base 142.

Once the base 142 is formed, a conductive material may be applied in a predetermined pattern on the base. This predetermined pattern may define a busbar 162 on the peripheral member 150 of the base 142 and a plurality of electrical contacts 166 on the fingers 152 of the base 142. The predetermined pattern of conductive material may be applied in any suitable technique. It is anticipated that precision screen printing and/or lithographic techniques commonly used to deposit conductive traces in printed circuit board manufacture may be advantageously employed here. After the conductive material is applied, the conductive material may be thermally treated to define a conductive trace bonded to the base 142. This thermal treatment may simply comprise heating the entire device in an oven or the like. In an alternative embodiment, a mask may be applied over the base 142 and the conductive material can be deposited on the base via CVD or PVD processes. If a resistor 168 is included in the leads 164, the resistors 168 can be applied in a separate step before or after the rest of the conductor 160 is applied.

If so desired, the contact ring 140 may be used in this state. As noted above, however, one embodiment of the contact ring 140 also includes a dielectric coating 175. This dielectric coating may be applied over a portion of the conductive trace, leaving at least a portion of each contact 166 exposed for electrical contact with a microelectronic workpiece. As noted above, the dielectric coating may comprise a plastic or an inorganic material, such as glass. In either circumstance, the dielectric material may be initially applied using screen painting or lithographic techniques analogous to those used to deposit the conductive material of the conductor 160. The dielectric coating could instead be applied using CVD or PVD processes, e.g., by sputtering silicon through a mask applied over the base 142. The coated device may be subjected to a second thermal treatment to better bond the dielectric coating to the dielectric base 142 and/or the conductor 160. If so desired, the thermal treatment of the conductor 160 and the dielectric coating 175 may take place in the same heating step.

Figure 6:
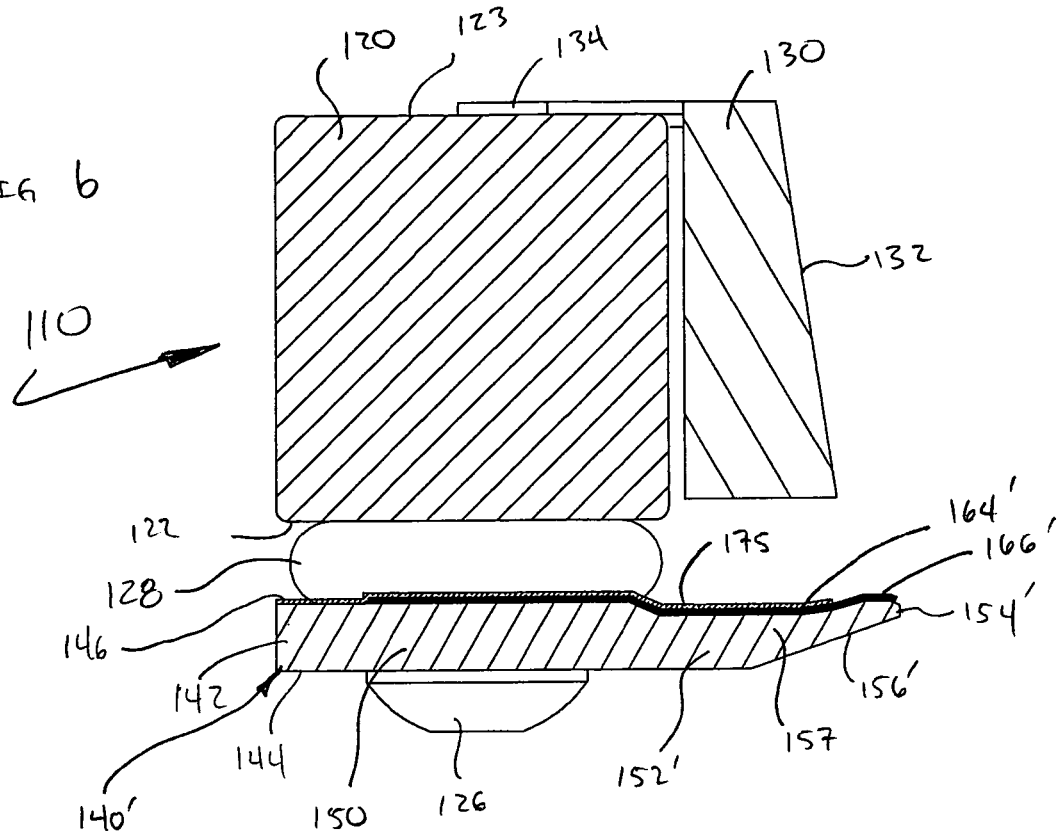
FIG. 6 is a partial cross-sectional view, similar to FIG. 5, of a contact assembly in accordance with an alternative embodiment of the invention.

FIG. 6 schematically illustrates a contact assembly 110 in accordance with another embodiment of the invention. The coupling member 120 and guide ring 130 may be substantially the same as that employed in the embodiment of FIG. 5. The primary difference lies in a reduced thickness of a portion of the fingers 152' of the contact ring 140' in FIG. 6. The contact ring 140 of FIG. 5 has a substantially constant thickness radially outwardly from the tapered distal length 156. In FIG. 6, an intermediate length 157 is disposed between the distal length 156' of each finger 152' and the peripheral member 150. This intermediate length may have a reduced thickness. In the illustrated embodiment, the contact face 146 of each finger dips downwardly toward the front face 144 along the intermediate length 157 to yield this reduced thickness. The reduced thickness of the intermediate length 157 reduces the cross-sectional area of the fingers 152', thus reducing the thickness of the fingers 152'. This can help control the degree of flexure of the fingers 152' in use if the dielectric base 142 is formed of a resilient material, such as a dielectric plastic.

Figure 7A:
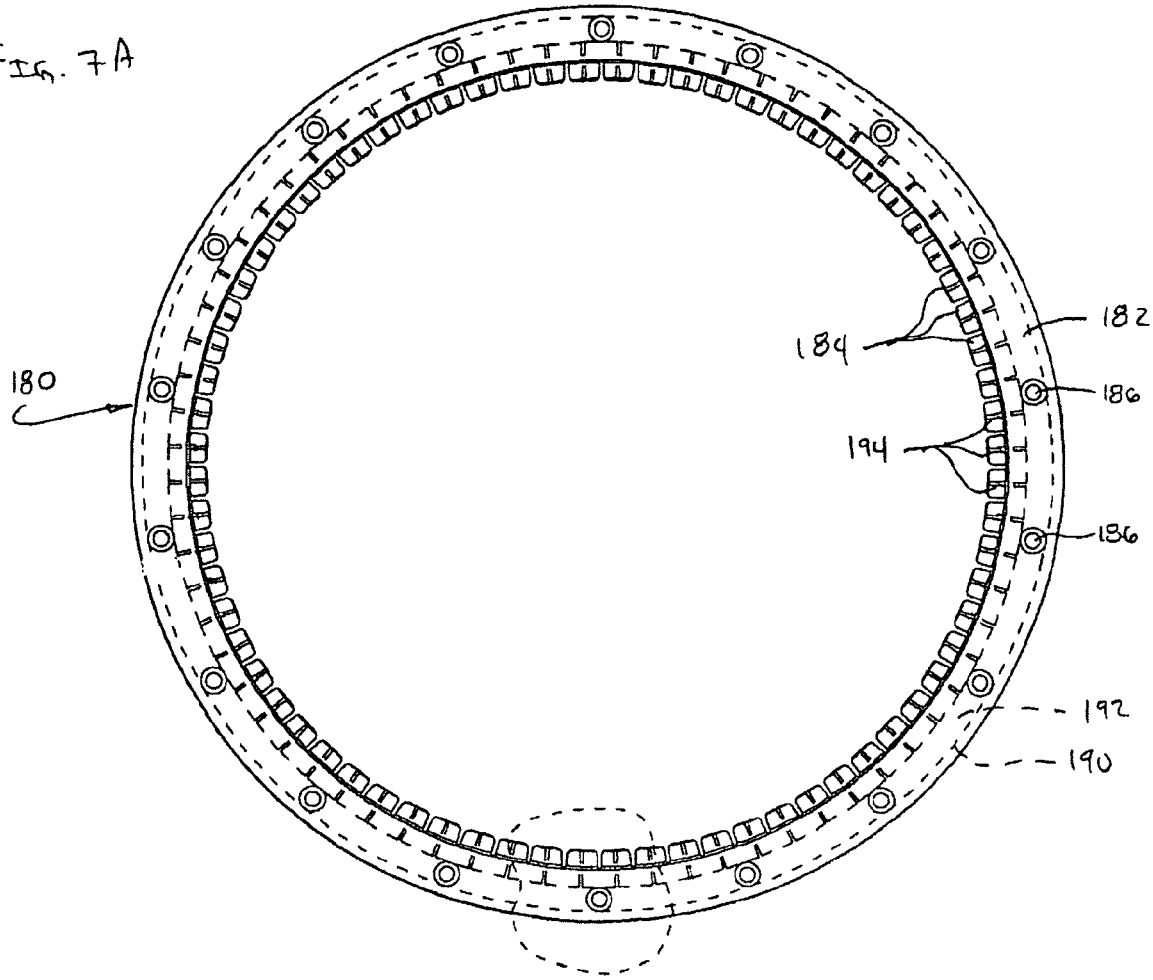
FIG. 7A is a front elevation view of a contact ring in accordance with an alternative embodiment of the invention.
Figure 7B:
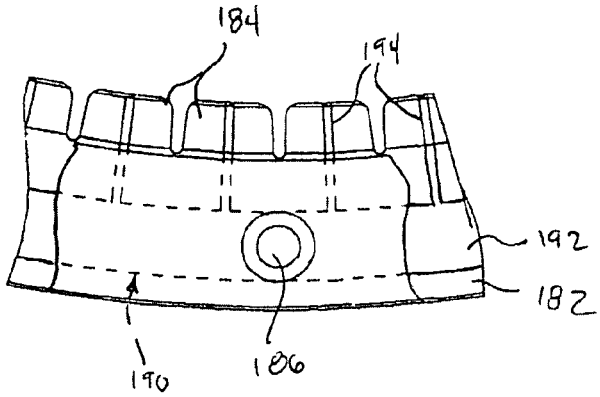
FIG. 7B is an isolation view showing a portion of the contact ring of FIG. 7A in greater detail.

FIGS. 7A-B illustrate a contact ring 180 in accordance with another embodiment of the invention. The contact ring 180 is similar to the contact ring 140 of FIGS. 3-5 in many respects. The contact ring 180 includes a peripheral member 182 having a plurality of fingers 184 extending radially inwardly therefrom. A plurality of mounting holes 186 may be spaced about the peripheral member 182 to mount the contact ring 180 to the coupling member 120. The contact ring 180 includes a conductor 190 having a busbar 192 carried on the peripheral member 182 and a plurality of electrical contacts 194, with each electrical contact being carried on a separate finger 184. The fingers 184 in FIG. 7A-B are wider than the fingers 152 of the contact ring 140 in FIGS. 3-5. As noted previously, the fingers 152 may have a reduced profile adjacent their inner ends to improve fluid dynamics as the electroplating solution flows radially outwardly across the fingers 152. The fingers 152 of the contact ring 140 are spaced an appreciable distance from one another. Unless the interior edge of the peripheral member 150 is tapered between the fingers 152, the relatively abrupt interior edge of the peripheral member 150 may increase turbulence somewhat. The contact ring 180 of FIGS. 7A-B employs wider fingers 184 which occupy a larger percentage of the interior surface of the peripheral member 150. The fingers 184 may have a reduced profile, similar to the shape discussed above in connection with FIG. 5 or FIG. 6. Reducing the gap between adjacent fingers 184 reduces the area of the relatively abrupt inner edge of the peripheral member 182 in the path of the fluid flow. This can further improve fluid dynamics as the electrochemical solution flows outwardly over the peripheral member 150.

As noted above, workpiece holders 100 in accordance with several embodiments of the invention also include a workpiece support 200. The workpiece support 200 is adapted to hold a microelectronic workpiece 30 against the contact assembly 110 with sufficient force to ensure reliable electrical contact between the contact assembly 110 and a conductive layer on the microelectronic workpiece, such as a seed layer. In accordance with one embodiment of the invention, the workpiece support may comprise a flat plate which urges the microelectronic workpiece 30 against the contact assembly 110 such that a peripheral portion of the front face of the microelectronic workpiece 30 is urged into electrical contact with the contact assembly 110. If the contact assembly 110 includes an improved contact ring in accordance with an embodiment of the invention (e.g., contact ring 140 or 180 of FIGS. 3-5 or 7, respectively), this would involve urging a peripheral region of the front face of the workpiece 30 into engagement with the contacts 166 or 194.

2. Selected Embodiments of Workpiece Supports for Microelectronic Workpiece Holders In accordance with several alternative embodiments of the invention, the workpiece support 200 is adapted to induce a controlled flexure of the microelectronic workpiece 30 when the workpiece 30 is grasped between the support 200 and the contact assembly 110. As explained below, inducing a controlled degree of curvature in the microelectronic workpiece 30 can improve contact with the contact assembly 110, particularly if a rigid contact ring 140 is employed.

FIGS. 8-9 illustrate two alternative workpiece supports adapted to induce controlled flexure of a microelectronic workpiece 30. Turning first to the embodiment of FIGS. 8A-B, this particular workpiece support 200 includes a body 202 having a rear face 204 and a forward face 206. The forward face 206 includes a first abutment 210*a* and a second abutment 210*b*. The first abutment 210*a* includes a first control surface 212*a* adapted to contact a back surface of a microelectronic workpiece at a first location. The second abutment 210*b* includes a second control surface 212*b* adapted to contact the back surface of the workpiece at a different location. The first and second control surfaces 212*a-b* may have a curved profile rather than defining sharp edges to minimize localized stress on the back surface of the microelectronic workpiece as it is flexed.

In one embodiment, the first and second control surfaces 212*a-b* of the first and second abutments 210*a-b* are contiguous to one another to define a more continuous control surface for the workpiece support 200. In the illustrated embodiment, the second abutment 210*b* is instead spaced radially outwardly from the first abutment 210*a*. The first abutment 210*a* comprises a raised annulus positioning the first control surface 212*a* a radius $R_1$ from the center of the workpiece support 200. The second abutment 210*b* is also a raised annulus and positions the second control surface 212*b* a larger radius $R_2$ from the same center of the workpiece.

The first and second control surfaces 212*a-b* may be formed with a high degree of precision to ensure that they contact the microelectronic workpiece at the desired relative positions. It is not necessary for the entire forward face 206 of the workpiece support 200 to be manufactured to a tight tolerance, though. Instead, the forward surface 206 may have a reduced height inside the first abutment 210*a*, defining a generally circular first recessed surface 214*a*. A generally annular second recessed surface 214*b* may extend between the concentric first and second abutments 210*a-b*. As these recessed surfaces 214 do not contact the workpiece 30, flaws or variations in these surfaces 214 will not affect precise control of the contact locations with the workpiece.

The first and second abutments 210*a-b* may have different heights. In the illustrated embodiment, the first control surface 212*a* of the first abutment 210*a* is spaced a height $h_1$ from the rear face 204 of the body 202. The second control surface 212*b* of the second abutment 210*b* is spaced a second height $h_2$ from the rear face 204. The first height $h_1$ is greater than the second height $h_2$. This leaves a height difference Δh between the first control surface 212*a* and the second control surface 212*b*. By appropriate selection of the radii $R_1$ and $R_2$ of the first and second abutments 210*a-b* and this height difference Δh, the degree of flexure of a microelectronic workpiece induced by the workpiece support 200 can be controlled.

The desired degree of curvature of the microelectronic workpiece will depend on a number of factors, including the material of which the microelectronic workpiece is formed and the size of the microelectronic workpiece. In one embodiment of the invention suitable for use in connection with a 200 mm silicon-based semiconductor wafer, the radius $R_1$ of the first abutment 210*a* is greater than one inch (about 25 mm), e.g., about 1.5 in. (about 38 mm). The second abutment 210*b* may extend about the outer periphery of the support 200 and the support 200 may have a diameter which is slightly less than the diameter of the microelectronic workpiece. Hence, the second radius $R_2$ in this embodiment may be about 3.85 in. (about 98 cm). The height difference Δh for this exemplary workpiece support 200 may range between about one mil (0.001 in., about 0.025 mm) to about 100 mils (about 2.5 mm). The height difference Δh may be selected to be as small as possible yet yield consistent, reliable electrical contact with the contact assembly 110. Accordingly, in one useful embodiment of the invention, the height difference Δh is about 8-32 mils (about 0.2-0.8 mm). In one more particular embodiment, the height difference Δh is about 8-16 mils (about 0.2-0.4 mm).

Another exemplary embodiment of the workpiece support 200 is suited for use with a 300 mm silicon-based semiconductor wafer. In one such embodiment, the radius $R_1$ of the first abutment 210*a* is greater than one inch, e.g., about 1.5 in. (about 38 mm); the radius $R_2$ of the second abutment 210*b* is slightly less than the size of the wafer, e.g., about 5.85 in. (about 148 mm); and the height difference Δh between the first and second control surfaces 212*a-b* is about 1-200 mils (about 0.03-5 mm), with a height difference of 8-50 mils (about 0.2-1.3 mm) being useful in a variety of applications and a range of 16-32 mils (about 0.4-0.8 mm) being well-suited for many applications.

Figure 9A:
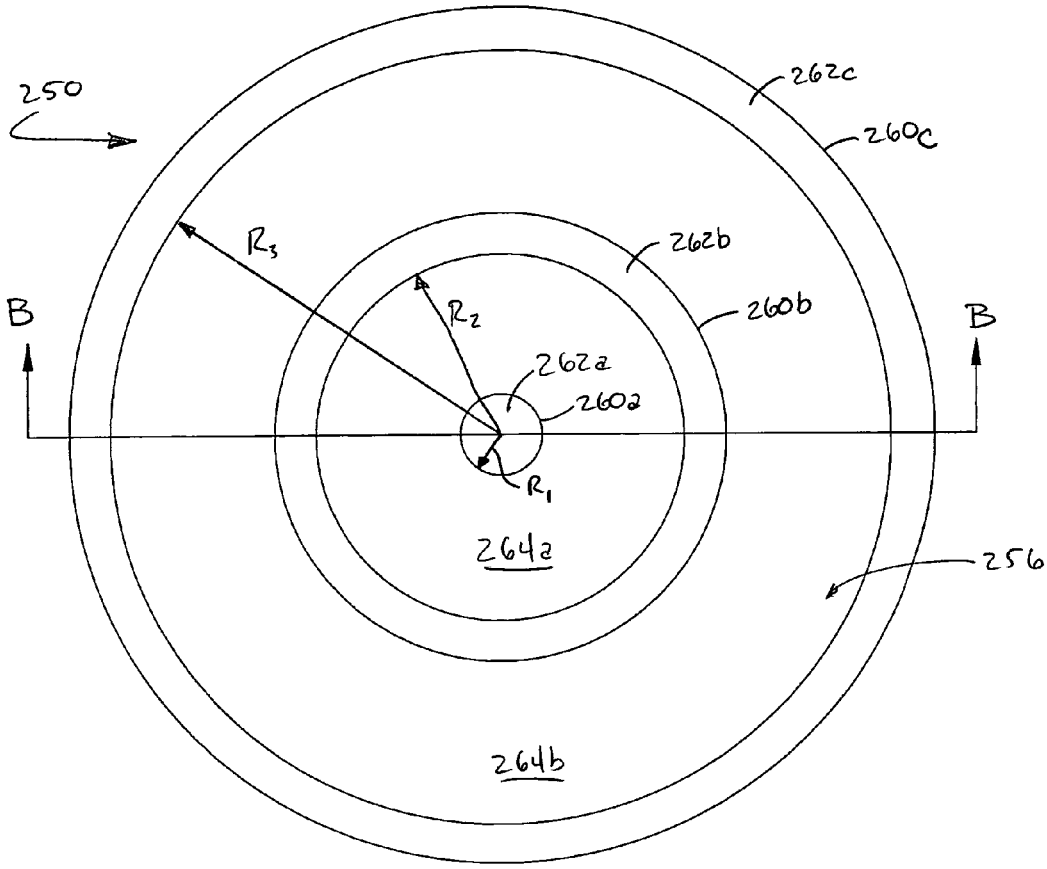
FIG. 9A is a top plan view of a workpiece support in accordance with another embodiment of the invention.
Figure 9B:
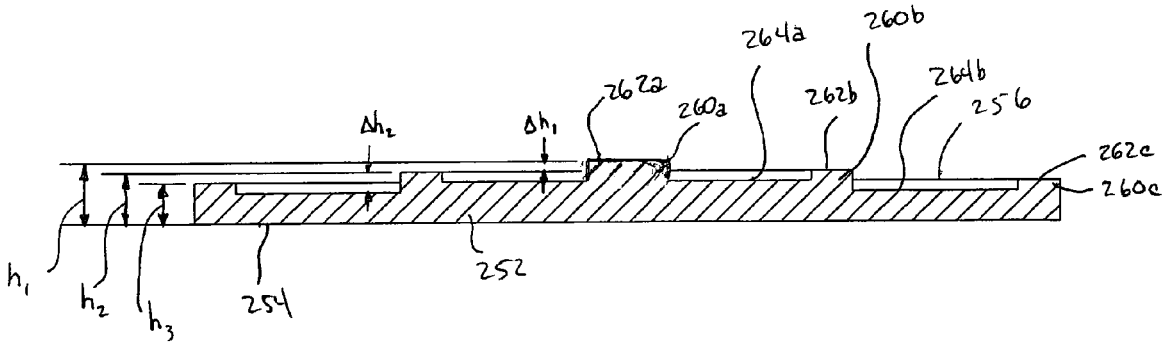
FIG. 9B is a cross-sectional view taken along line B-B of FIG. 9A.

FIGS. 9A-B illustrate a workpiece support 250 in accordance with an alternative embodiment of the invention. This workpiece support 250 shares many similarities with the workpiece support 200 of FIGS. 8A-B. In particular, the workpiece support 250 includes a body 252 having a rear face 254 and a forward face 256. The forward face 256 includes a plurality of abutments adapted to contact the back surface of a microelectronic workpiece at spaced-apart locations, namely, a central first abutment 260*a*, an annular second abutment 260*b*, and an annular third abutment 260*c*. The first abutment 260*a* may comprise a generally circular pedestal having a radius $R_1$, defining a generally circular first control surface 262*a*. The second abutment 260*b* is spaced a radius $R_2$ from the center of the workpiece support 250 and defines an annular second control surface 262*b*. The third abutment 260*c* is spaced a radius $R_3$ from the center of the support 250 and defines an annular third control surface 262*c* adjacent the periphery of the workpiece support 250.

Each of the control surfaces 262*a-c* may have a different height. Hence, the first control surface 262*a* is spaced a height $h_1$ from the rear face 254 of the support 250, the second control surface 262*b* is spaced a height $h_2$ from the rear face 254, and the third control surface 262*c* is spaced a height $h_3$ from the rear face 254. In one embodiment of the invention, the height decreases moving radially outwardly from the center of the workpiece support 250, i.e., $h_1>h_2>h_3$. This yields a first height difference $\Delta h_1$ between the first and second control surfaces 262*a-b* and a second height difference $\Delta h_2$ between the second and third control surfaces 262*b-c*. The degree and shape of the flexure of the microelectronic workpiece in response to the force of the support 250 against the back surface of the workpiece can be controlled by appropriate selection of the radii $R_1$-$R_3$ and heights $h_1$-$h_3$.

The three control surfaces 262*a-c* of the support 250 are spaced from one another, leaving a first annular recessed surface 264*a* between the first and second abutments 260*a-b* and a second annular recessed surface 264*b* between the second and third abutments 260*b-c*. This provides three discrete, spaced-apart control surfaces 262*a-c*. It should be understood that four or more discrete control surfaces 262 could be used instead. In each of the embodiments, the control surfaces are shown as being continuous, such as circular or annular surfaces. If so desired, a series of appropriately spaced abutments having predetermined heights could be arranged on the surface of the support rather than using continuous annular or circular control surfaces as shown in FIGS. 8-9.

In one embodiment of the invention, the entire forward surface 206 or 256 of the support 200 or 250 may define a curved, continuous control surface. If the support could be made with appropriate control and manufacturing tolerances at a reasonable cost, this could yield good control over the shape of the flexed microelectronic component. Utilizing a series of spaced-apart control surfaces as shown in FIGS. 8-9 with recessed surfaces therebetween facilitates cost effective manufacture, though. The abutments 210 or 260 can be manufactured with a high degree of precision with exacting tolerances while the recessed areas between the abutments can be much less precisely machined. Because the control surfaces 210 or 260 define the areas of contact between the support 200 or 250 and the back surface of the microelectronic workpiece, this should yield sufficient control over the flexure of the workpiece without unduly increasing manufacturing costs of the workpiece support.

Figure 10A:
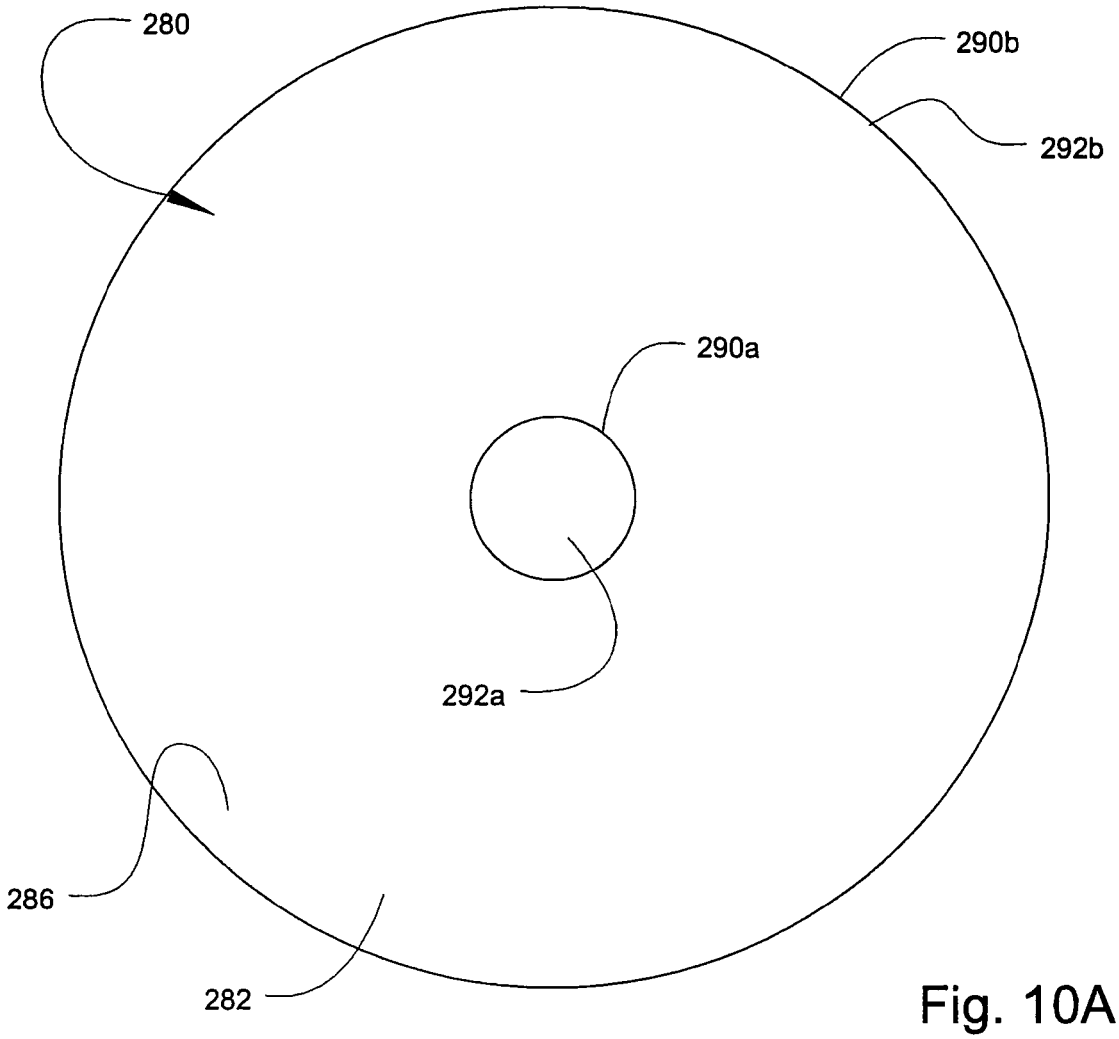
FIGS. 10 A and 10 B are top and side elevation views of a workpiece support in accordance with still another embodiment of the invention.
Figure 10B:
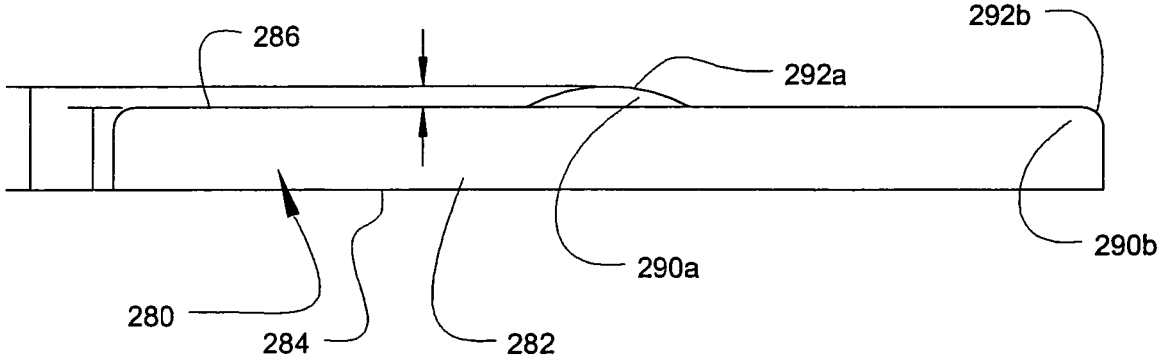

FIGS. 10A-B illustrate a microelectronic workpiece support 280 in accordance with another embodiment of the invention. This workpiece support 280 includes a body 282 having a back face 284 and a forward face 286. A generally dome-shaped first abutment 290 a having a first control surface 292*a* may be centered on the circular forward face 286. An outer rim 290*b* of the forward face 286 may define a second control surface 292*b* spaced radially outwardly from the first control surface 292*a*. The first control surface 292*a* has a maximum height $h_1$ from the back face 284. The second control surface 292*b* may have a lesser second height $h_2$ from the back face 284, leaving a height difference Δh between the spaced-apart first and second control surfaces 292*a-b* to induce the desired flexure of a microelectronic workpiece in contact with the support 280. To reduce localization of stress on the periphery of the microelectronic workpiece, the rim 290*b* may be rounded or beveled to yield a second control surface 292*b* which is curved (as shown) or angled.

The support 200, 250, or 280 can be formed of any desired material. In one embodiment, the support is formed of a material capable of high precision machining or other high precision forming techniques. The material may have a high Young's modulus to reduce flexing of the support in use. The material may also be relatively hard and wear-resistant to ensure greater dimensional uniformity of the support over time. Suitable materials for forming the support 200 or 250 include ceramics (e.g., aluminum or silicon carbide), metals (e.g., aluminum coated with diamond-like carbon via CVD or PVD), or hard, rigid plastics. If the support is formed of a ceramic, the general forming process for the support may be similar to that of forming the dielectric base 142 of the contact ring 140 discussed above.

Figure 11:
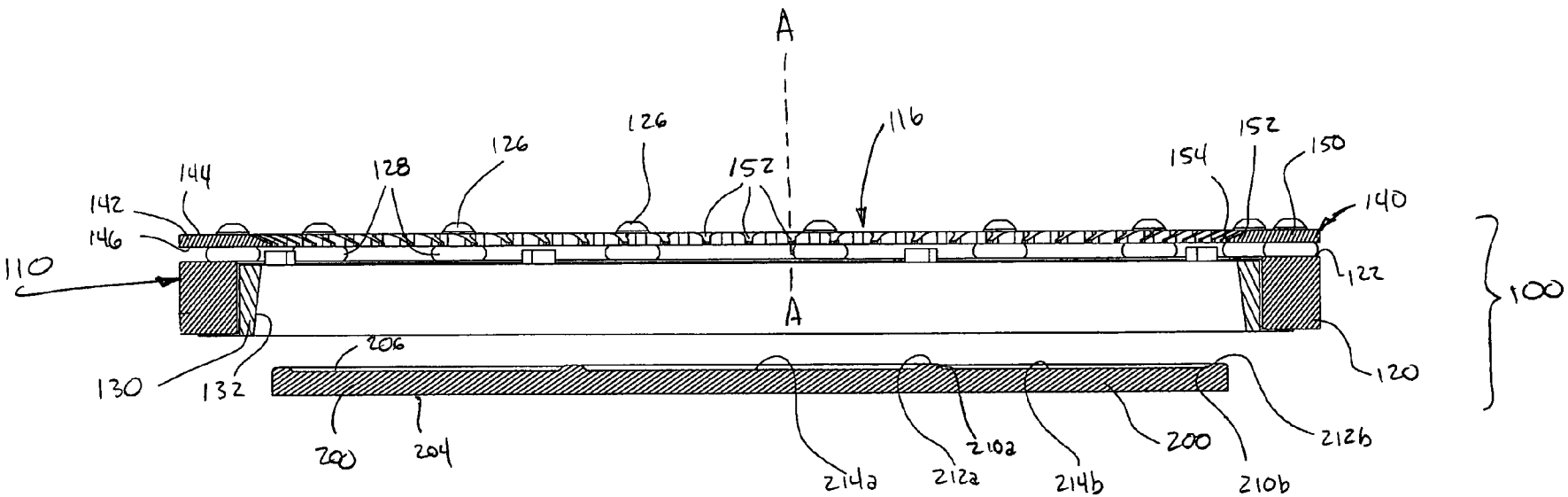
FIG. 11 is a cross-sectional view of the workpiece holder of FIG. 3 in its open configuration with no workpiece.
Figure 12:
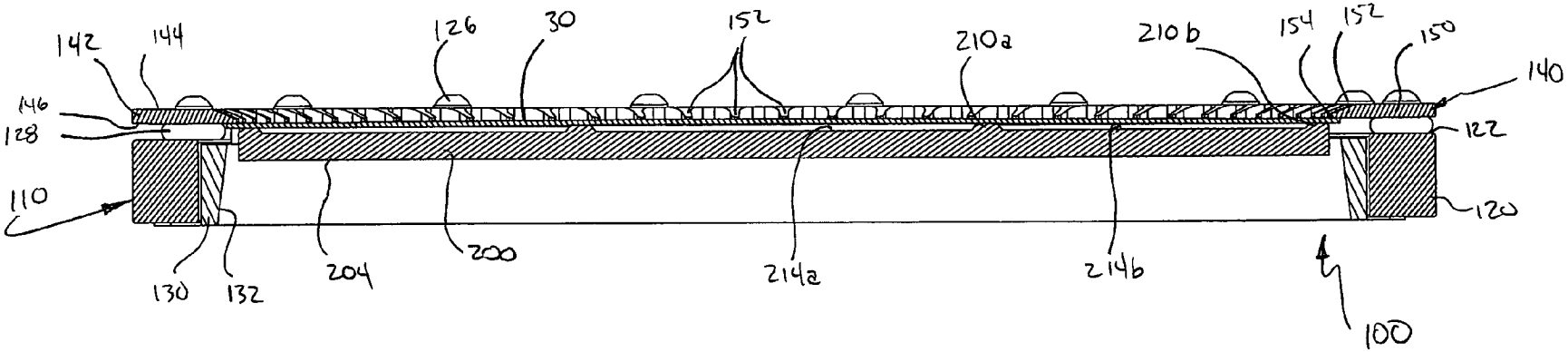
FIG. 12 is a cross-sectional view of the workpiece holder of FIG. 11 with a workpiece grasped between the contact assembly and the support plate.
Figure 13:
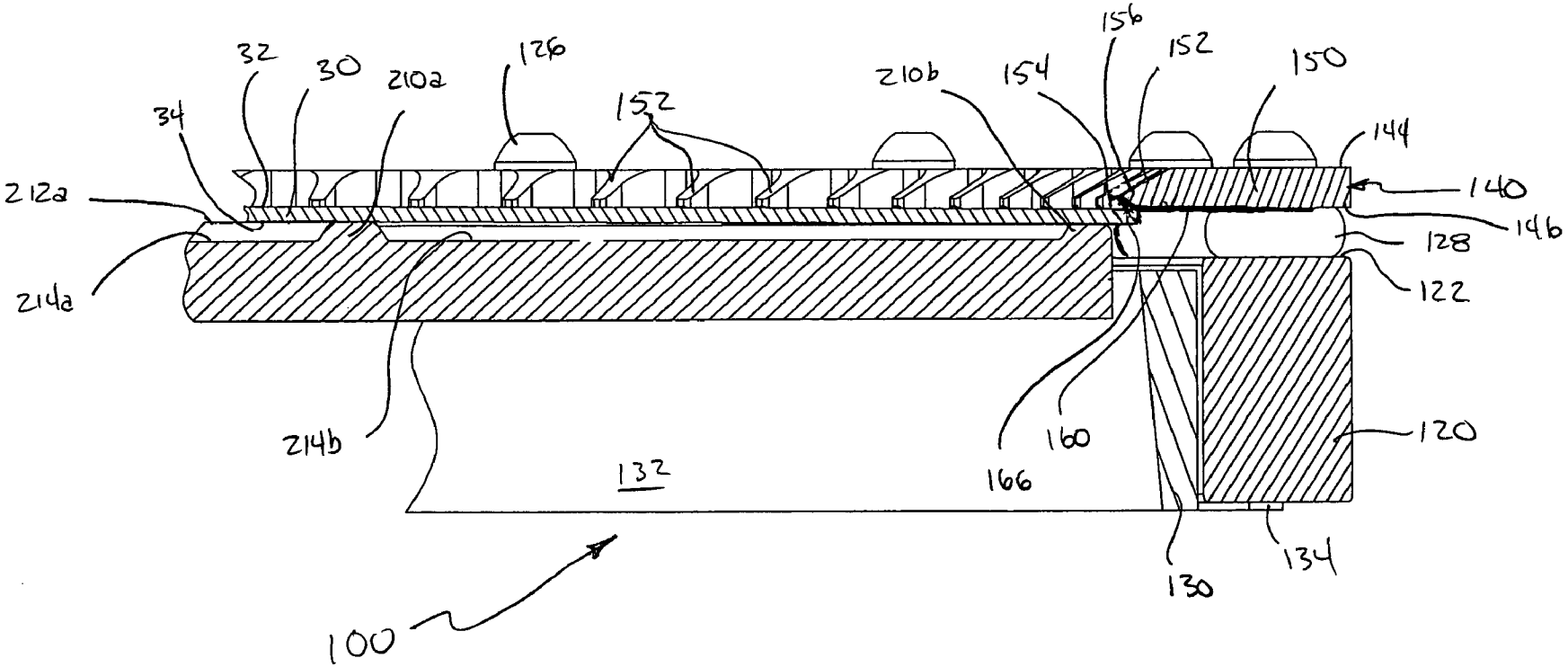
FIG. 13 is a partially broken-away isolation view showing a portion of FIG. 12 in greater detail.

C. Exemplary Methods of Operation of Selected Embodiments of Microelectronic Workpiece Holders FIGS. 11-13 illustrate the workpiece holder 100 of FIG. 3 in use. The workpiece holder 100 is shown in FIGS. 2 and 3 with the contact assembly 110 oriented downwardly toward the electrochemical solution in the bowl 40. As noted above, in one embodiment of the invention, the head assembly 70 may be pivoted about a generally horizontal axis to load and unload workpieces 30 from the workpiece holder 100. FIGS. 11-13 illustrate the workpiece holder 100 in this inverted position.

The workpiece holder 100 shown in FIG. 11 includes a workpiece support 200 generally as shown in FIGS. 8A-B and a contact assembly 100 including a contact ring 140 generally as shown in FIGS. 3-5. In FIG. 11, the wafer support 100 is in an open configuration wherein the workpiece support 200 is spaced away from the contact ring 140 along the axis A-A of the opening 116 through the contact ring 140. A workpiece (not shown in FIG. 11) can be positioned between the support 200 and the contact assembly 110 and the back surface of the workpiece may be placed upon the support 200. Since the first abutment 210*a* has a height greater than the rest of the front surface 206 of the support 200, the back surface of a planar workpiece may be supported essentially exclusively by the first control surface 212*a*.

FIGS. 12 and 13 show the workpiece holder 100 grasping a workpiece 30. In moving from the arrangement of FIG. 11 to that of FIGS. 12 and 13, the workpiece support 200 is moved with respect to the contact assembly 110 generally along the axis A-A (FIG. 11) of the opening in the contact ring 140. The support 200 is moved toward the contact ring 140 until the front face 32 of the microelectronic workpiece 30 contacts the contact ring 140. When the workpiece first contacts the contact ring 140, the peripheral portion of the back surface 34 of the workpiece 30 will still be spaced above the control surface 212*b* of the second abutment 210*b*. In FIGS. 12 and 13, the support 200 has been moved further toward the contact ring 140 so that the second abutment 210*b* of the support 200 also supportively engages the back surface 34 of the workpiece 30.

Due to the height difference (Δh in FIG. 8B) between the first and second abutments 210*a-b*, the microelectronic workpiece 30, which may be substantially planar when in a relaxed state, may flex in a controlled fashion. In the illustrated embodiment, the height differential between the annular first control surface 212*a* of the first abutment 210*a* and the annular second control surface 212*b* of the second abutment 210*b* will bow the microelectronic workpiece 30 such that the front face 32 of the workpiece 30 will have an outwardly convex shape while the back face 34 will have an outwardly concave face. The height difference Δh between the abutments 210*a-b* may be relatively small in comparison to the overall diameter of the microelectronic workpiece, so the curvature of the microelectronic workpiece 30 in FIGS. 11 and 12 is not particularly pronounced. Nonetheless, this controlled flexure of the microelectronic component 30 is expected to ensure relatively uniform, consistent contact about the entire periphery of the front face 32 of the workpiece 30.

As noted above, the noses 154 of the contact ring fingers 152 may have an angled bottom surface, yielding an angled shape to the contact 166 carried thereon. Due to the bending of the microelectronic workpiece 30, the contact 166 is expected to contact the front face 32 of the workpiece 30 primarily along a line of contact (167 in FIG. 4B) corresponding with the position where the nose 154 of the finger 152 is angled.

In the embodiment of FIGS. 12 and 13, the support 200 has a diameter which is smaller than the diameter of the workpiece 30 and the fingers 152 of the contact ring 140 contact a peripheral region of the workpiece front surface 32 spaced radially outwardly from the outer edge of the support 200. This can increase the bending force applied on the microelectronic component 30. In an alternative embodiment of the invention, the second abutment 210*b* is positioned opposite the point of contact between the front surface 32 of the workpiece 30 and the fingers 152. This will reduce the stress on the peripheral portion of the workpiece 30 while still inducing bending due to the height difference Δh between the control surfaces 212*a-b*.

It should be noted that supports in accordance with various embodiments of the invention (e.g., supports 200, 250, or 280) need not be used with a composite contact ring 140 as shown in the drawings. Conventional electrical contacts having relatively flexible fingers which are brought into contact with the front surface 32 of the workpiece 30 may still provide sufficient force against the periphery of the workpiece 30 to bring it into supportive contact with each of the control surfaces 212 of the support 200. This curvature of the microelectronic workpiece can, therefore, yield beneficial improvements in the contact uniformity between the workpiece front surface 32 and the contact ring.

It is anticipated that the workpiece holder 100 of various embodiments of the invention can be used beneficially in electrochemically treating semiconductor workpieces, such as in electroplating silicon-based semiconductor wafers. Out of fear of catastrophically damaging the wafer, such wafers conventionally are deemed too valuable and too brittle to bend. Supports (e.g., support 200, 250, or 280) in accordance with embodiments of the present invention, however, supportively contact predefined locations on the back surface of the microelectronic workpiece. Forcing a peripheral region of the workpiece 30 against a contact ring (e.g., contact ring 140, though other contacts could be used instead) will controllably deform the workpiece into a predefined configuration. By appropriate selection of the location and dimensions of the control surfaces and the height differential between the control surfaces, the flexure induced in the microelectronic workpiece can be fairly precisely controlled to mitigate the likelihood of damaging the workpiece 30.

Inducing a controlled flexure of the workpiece 30, however, promotes reliable contact between the workpiece front surface 32 and each of the fingers 152 of the contact ring 140 (or other contact system). Improving uniformity of electrical coupling minimizes variations in plating of semiconductor wafers which may otherwise arise due to imperfections in the planarity of the semiconductor wafer, the positions and dimensions of the fingers of a contact ring, and other variations which could lead to inconsistent contact force between the semiconductor wafer and the contact ring from one location to the next. Not only with such uniform electrical coupling materially improve plating uniformity across the surface of a single wafer, it can also reduce variations in plating results from one wafer to the next. This can enhance product yield and reduce the likelihood that a wafer will need to be plated with an excessively thick metal layer, which is removed in later polishing operations, to ensure at least minimum coverage across the entire wafer surface.

From the foregoing, it will be appreciated that specific embodiments of the invention have been described herein for purposes of illustration, but that various modifications may be made without deviating from the spirit and scope of the invention. Accordingly, the invention is not limited except as by the appended claims.

The invention claimed is:

1. A reactor system for electrochemically treating microelectronic workpieces, comprising:

a bowl configured to hold an electrochemical solution;

an electrode positioned for electrical contact with the electrochemical solution and being adapted to be operatively coupled to an electrical power supply; and a workpiece holder adapted to position at least a portion of a microelectronic workpiece in contact with the electrochemical solution, the workpiece holder comprising:

a contact ring comprising a rigid dielectric base, a plurality of electrical contacts, and a busbar, the base having a peripheral member and a plurality of fingers extending inwardly from the peripheral member, each of the electrical contacts being carried on a finger of the base and having an exposed contact pad adapted to electrically contact a conductive surface of a microelectronic workpiece, the busbar being carried by the peripheral member of the base, the busbar being adapted to electrically couple the electrical contacts to the electrical power supply;

a workpiece support adapted to support the workpiece with respect to the contact ring; and a dielectric coating covering at least a portion of the busbar.

2. The reactor system of claim 1 wherein each of the contacts includes a lead, the dielectric coating covering at least a portion of the lead but leaving the contact exposed.

3. The reactor system of claim 1 wherein the contact ring is positioned to contact the electrochemical solution when the workpiece is in contact with the electrochemical solution.

4. A composite electrochemistry contact ring, comprising:

a dielectric base having a contact face and an interior opening through which an electrolyte may pass to contact a surface of a microelectronic workpiece;

a conductor carried by the contact face of the base, the conductor comprising an outer busbar and a plurality of spaced-apart contacts positioned inwardly of and electrically coupled to the busbar;

a dielectric coating covering at least a portion of the busbar, at least a portion of each of the contacts remaining exposed for electrically contacting the workpiece.

5. The contact ring of claim 4 wherein the conductor comprises a conductive trace bonded to the base contact face.

6. The contact ring of claim 4 wherein each contact has a non-linear profile adapted to facilitate electrical contact with a curved microelectronic workpiece.

7. The contact ring of claim 6 wherein each contact is angled with respect to a plane perpendicular to an axis of the interior opening.

8. The contact ring of claim 4 further comprising a plurality of leads, each of the leads electrically coupling one of the contacts to the busbar.

9. The contact ring of claim 8 wherein each lead includes a resistor.

10. The contact ring of claim 9 wherein each resistor comprises a length of the lead having an increased resistance.

11. The contact ring of claim 8 wherein each lead comprises a first length comprising a first conductive material and a second length comprising a second conductive material, the second conductive material having a resistivity greater than a resistivity of the first conductive material.

12. The contact ring of claim 11 wherein the first length of each lead and the contacts each comprise the first conductive material.

13. The contact ring of claim 11 wherein the first lengths of the leads, the contacts and the busbar each comprise the first conductive material.

14. The contact ring of claim 4 wherein the dielectric base comprises a refractory material.

15. The contact ring of claim 4 wherein the dielectric base comprises a ceramic.

16. The contact ring of claim 15 wherein the conductor comprises a metallic conductive trace bonded to the base contact face.

17. The contact ring of claim 4 wherein the dielectric base is rigid.

18. The contact ring of claim 4 wherein the dielectric base comprises a peripheral member and a plurality of fingers extending inwardly from the peripheral member, each of the fingers supporting a different one of the contacts of the conductor.

19. The contact ring of claim 18 wherein each of the fingers tapers in thickness radially inwardly from the peripheral member.

20. The contact ring of claim 18 wherein each of the fingers has a reduced profile adjacent an inner end.

21. The contact ring of claim 4 wherein the dielectric base and the dielectric coating each comprises a ceramic.

22. The contact ring of claim 21 wherein the dielectric base and the dielectric coating are formed of different materials.

* * * * *